US009664397B2

(12) United States Patent
Yamashita et al.

(10) Patent No.: US 9,664,397 B2
(45) Date of Patent: May 30, 2017

(54) AIR-CONDITIONING APPARATUS WITH REVERSIBLE HEAT MEDIUM CIRCUIT

(75) Inventors: Koji Yamashita, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1044 days.

(21) Appl. No.: 13/823,633

(22) PCT Filed: Nov. 10, 2011

(86) PCT No.: PCT/JP2011/006281
§ 371 (c)(1),
(2), (4) Date: Mar. 14, 2013

(87) PCT Pub. No.: WO2012/070192
PCT Pub. Date: May 31, 2012

(65) Prior Publication Data

US 2013/0174594 A1 Jul. 11, 2013

(30) Foreign Application Priority Data

Nov. 24, 2010 (WO) ..... PCT/JP2010/006844

(51) Int. Cl.

| | |
|---|---|
| ***F25B 13/00*** | (2006.01) |
| ***F24F 3/08*** | (2006.01) |
| ***F24F 3/06*** | (2006.01) |
| ***F25D 17/02*** | (2006.01) |
| ***F25B 25/00*** | (2006.01) |

(52) U.S. Cl.
CPC ..... *F24F 3/08* (2013.01); *F24F 3/06* (2013.01); *F25B 13/00* (2013.01); *F25B 25/005* (2013.01); *F25D 17/02* (2013.01); *F24F 3/065* (2013.01); *F25B 2313/0231* (2013.01); *F25B 2313/0272* (2013.01); *F25B 2313/02732* (2013.01); *F25B 2313/02741* (2013.01); *F25B 2339/047* (2013.01)

(58) Field of Classification Search
CPC ..... F25B 7/00; F25B 25/00; F25B 25/005; F25B 2313/004; F25B 2313/0231
See application file for complete search history.

(56) References Cited

U.S. PATENT DOCUMENTS

| | | | | |
|---|---|---|---|---|
| 5,269,638 | A | 12/1993 | Sindermann et al. | |
| 6,237,356 | B1 * | 5/2001 | Hori | F25B 25/005 62/238.4 |
| 2011/0079042 | A1 | 4/2011 | Yamashita et al. | |

FOREIGN PATENT DOCUMENTS

| | | | |
|---|---|---|---|
| CN | 2338556 | Y | 9/1999 |
| EP | 0 887 599 | A1 | 12/1998 |
| JP | 48-35543 | U | 4/1973 |
| JP | 62-293056 | A | 12/1987 |

(Continued)

OTHER PUBLICATIONS

JP 08-086477 (English abstract).*

(Continued)

*Primary Examiner* — Jonathan Bradford
(74) *Attorney, Agent, or Firm* — Posz Law Group, PLC

(57) ABSTRACT

An air-conditioning apparatus includes a heat medium circuit with a heat medium flow reversing device that can switch the flow direction of a heat medium in the heat medium side passage of the heat exchanger related to heat medium.

21 Claims, 11 Drawing Sheets

(56) References Cited

FOREIGN PATENT DOCUMENTS

| | | | |
|---|---|---|---|
| JP | 63-153372 | A | 6/1988 |
| JP | 63-014052 | A | 7/1989 |
| JP | 05-280818 | A | 10/1993 |
| JP | 06-058440 | A | 3/1994 |
| JP | 07-20476 | U | 4/1995 |
| JP | 07-103596 | A | 4/1995 |
| JP | 08-086477 | A | 4/1996 |
| JP | 10-281575 | A | 10/1998 |
| JP | 2001-289465 | A | 10/2001 |
| JP | 2002-267286 | A | 9/2002 |
| JP | 2003-343936 | A | 12/2003 |
| JP | 2005-140444 | A | 6/2005 |
| JP | 2008-051427 | A | 3/2008 |
| WO | 2009/154149 | A1 | 12/2009 |
| WO | 2010/049998 | A1 | 5/2010 |
| WO | 2010/050002 | A1 | 5/2010 |
| WO | 2010/119555 | A1 | 10/2010 |
| WO | 2010/131378 | A1 | 11/2010 |

OTHER PUBLICATIONS

JP 2002-106995 (English translation).*
Extended European Search Report dated May 6, 2014 issued in corresponding EP patent application No. 11842473.8.
Office Action issued Feb. 18, 2014 for the corresponding Japanese Patent Application No. 2012-545602 (with English translation).
Office Action dated Sep. 23, 2014 issued in corresponding CN patent application No. 201180054167.0 (and English translation).
Office Action mailed on Nov. 18, 2014 issued in corresponding JP patent application No. 2014-053855 (and English translation).
Office Action mailed Jan. 6, 2015 issued in corresponding JP patent application No. 2014-053976 (and English translation).
Office Action dated Mar. 9, 2015 issued in corresponding CN patent application No. 201180054167.0 (and English translation).
Office Action mailed Jun. 9, 2015 in the corresponding Japanese patent application No. 2014-053855 (English translation attached).
Office Action dated Jul. 24, 2015 issued in corresponding CN patent application No. 201180054167.0 (and English translation).
Office Action mailed Jul. 7, 2015 in the corresponding JP application No. 2014-053976 (with English translation).
Chinese Office Action was issued on Mar. 23, 2016 in the corresponding CN application No. 201180054167.0. (English translation attached).
International Search Report of the International Searching Authority mailed Dec. 13, 2011 for the corresponding international application No. PCT/JP2011/006281 (with English translation).
Office Action mailed on Aug. 19, 2014 for corresponding JP patent application No. 2012-545602 (and English translation).
Office Action dated Jul. 29, 2016 issued in corresponding CN patent application No. 201180054167.0 (and English translation).
Decision on Appeal mail date of Sep. 27, 2016 in the corresponding JP application No. 2014-53855 (English translation attached).

* cited by examiner

AIR-CONDITIONING APPARATUS WITH REVERSIBLE HEAT MEDIUM CIRCUIT

CROSS REFERENCE TO RELATED APPLICATIONS

This application is a U.S. national stage application of International Application No. PCT/JP2011/006281 filed on Nov. 10, 2011 and claims priority to, and incorporates by reference, International Application No. PCT/JP2010/006844 filed on Nov. 24, 2010.

TECHNICAL FIELD

The present invention relates to an air-conditioning apparatus that is applied to, for example, a multi-air-conditioning apparatus for an office building.

BACKGROUND ART

A conventional air-conditioning apparatus, such as a multi-air-conditioning apparatus for an office building, performs a cooling operation or a heating operation by, for example, circulating a refrigerant between an outdoor unit, which is a heat source unit disposed outside of a structure, and indoor units disposed inside of a structure. Specifically, a conditioned space is cooled with air that has been cooled by a refrigerant removing heat from air and is heated with air that has been heated by the refrigerant transferring its heat. Regarding the refrigerant used for such an air-conditioning apparatus, hydrofluorocarbon (HFC) refrigerant, for example, is typically used. An air-conditioning apparatus has also been developed which uses a natural refrigerant, such as carbon dioxide (CO2).

In an air-conditioning apparatus called a chiller, cooling energy or heating energy is generated in a heat source unit disposed outside of a structure. Water, antifreeze, or the like is heated or cooled by a heat exchanger disposed in an outdoor unit, and conveyed to an indoor unit, such as a fan coil unit or a panel heater. And thereby, heating or cooling is performed (refer to Patent Literature 1, for example).

An air-conditioning apparatus called a heat recovery chiller is constituted such that a heat source unit is connected to each indoor unit by four water pipes arranged therebetween and, cooled water and heated water and the like are simultaneously supplied so that cooling or heating can be freely selected in indoor units (refer to Patent Literature 2, for example).

Further, an air-conditioning apparatus has been developed in which a heat exchanger for a primary refrigerant and a secondary refrigerant is disposed near each indoor unit to convey the secondary refrigerant to the indoor units (refer to Patent Literature 3, for example).

Furthermore, an air-conditioning apparatus has also been developed which is constituted such that an outdoor unit is connected to each branch unit including a heat exchanger by two pipes to convey a secondary refrigerant to an indoor unit (refer to Patent Literature 4, for example).

Moreover, air-conditioning apparatuses, such as a multi-air-conditioning apparatus for an office building, include an air-conditioning apparatus in which a refrigerant is circulated from an outdoor unit to a relay unit and a heat medium, such as water, is circulated from the relay unit to each indoor unit to reduce conveyance power for the heat medium while circulating the heat medium, such as water, through the indoor unit (refer to Patent Literature 5, for example).

CITATION LIST

Patent Literature

Patent Literature 1: Japanese Unexamined Patent Application Publication No. 2005-140444 (Page. 4, FIG. 1, for example)

Patent Literature 2: Japanese Unexamined Patent Application Publication No. 5-280818 (Pages. 4 and 5, FIG. 1, for example)

Patent Literature 3: Japanese Unexamined Patent Application Publication No. 2001-289465 (Pages. 5 to 8, FIGS. 1, and. 2, for example)

Patent Literature 4: Japanese Unexamined Patent Application Publication No. 2003-343936 (p. 5, FIG. 1)

Patent Literature 5: WO10/049,998 (Page 3, FIG. 1, for example)

SUMMARY OF INVENTION

Technical Problem

In an air-conditioning apparatus in related art, such as a multi-air-conditioning apparatus for an office building, a refrigerant may leak into, for example, an indoor space because the refrigerant is circulated up to an indoor unit. In the air-conditioning apparatuses as described in Patent Literature 1 and Patent Literature 2, a refrigerant is circulated only within the heat source unit disposed outdoors, and the refrigerant does not pass through the indoor unit. It is however necessary to heat or cool a heat medium in a heat source unit disposed outside of a structure and convey it to the indoor unit in the air-conditioning apparatus like those disclosed in Patent Literature 1 and Patent Literature 2. Accordingly, the circulation path for the heat medium becomes long. In this case, in conveying heat for predetermined heating or cooling using the heat medium, the amount of energy consumed as conveyance power and the like by the heat medium is higher than that by the refrigerant. As the circulation path becomes longer, therefore, the conveyance power markedly increases. This indicates that energy can be saved as long as the circulation of the heat medium can be properly controlled in the air-conditioning apparatus.

In the air-conditioning apparatus disclosed in Patent Literature 2, four pipes have to be connected between an outdoor side and indoor space so that cooling or heating can be selected in each indoor unit. Disadvantageously, it is not easy to install this apparatus. In the air-conditioning apparatus disclosed in Patent Literature 3, secondary medium circulating means, such as a pump, has to be provided for each indoor unit. Disadvantageously, the system is costly and the noise is loud, therefore, this apparatus is not practical. In addition, since the heat exchanger is placed near each indoor unit, there always remains the risk that the refrigerant may leak into a place near the indoor space.

In the air-conditioning apparatus disclosed in Patent Literature 4, a primary refrigerant subjected to heat exchange flows into the same passage as that for the primary refrigerant to be subjected to heat exchange. In such a case, when a plurality of indoor units are connected, it is difficult for each indoor unit to exhibit a maximum capacity. Such a configuration wastes energy. Furthermore, each branch unit is connected to an extension pipe by two pipes for cooling and two pipes for heating, namely, four pipes in total. Consequently, this configuration is similar to that of a system in which the outdoor unit is connected to each branch unit by four pipes. Accordingly, it is not easy to install this apparatus.

Although the air-conditioning apparatus as described in Patent Literature presents no problem in a case where a single refrigerant or a near-azeotropic refrigerant is used as the refrigerant, in a case where a zeotropic refrigerant mixture is used as the refrigerant, there is a possibility that when using a refrigerant-heat medium heat exchanger as an evaporator, the heat exchange performance between the refrigerant and the heat medium may decrease owing to the temperature gradient between the saturated liquid temperature and saturated gas temperature of the refrigerant.

The invention has been made to overcome the above problems and aims to provide an air-conditioning apparatus that is capable of saving energy. The invention aims to provide an air-conditioning apparatus that can improve safety without circulating a refrigerant in or near an indoor unit. The invention aims to provide an air-conditioning apparatus that can reduce the number of connecting pipes between an outdoor unit and a branch unit (heat medium relay unit) or an indoor unit to make the construction easier, and improve energy efficiency.

Solution to Problem

An air-conditioning apparatus according to the invention has a refrigerant circuit in which a compressor, a first heat exchanger, a first expansion device, and a refrigerant side passage of a second heat exchanger are connected by refrigerant pipes to circulate a heat source side refrigerant; and a heat medium circuit in which a pump and a heat medium side passage of the second heat exchanger are connected by heat medium pipes to circulate a heat medium. The second heat exchanger exchanges heat between the heat source side refrigerant and the heat medium. Further the air-conditioning apparatus also includes a heat medium flow reversing device provided in the heat medium circuit for switching a flow direction of the heat medium in the heat medium side passage of the second heat exchanger.

Advantageous Effects of Invention

Since the air-conditioning apparatus according to the invention requires less conveyance power because pipes through which the heat medium circulates can be shortened, the apparatus can improve safety and save energy. In addition, even if the heat medium leaks to the outside of the air-conditioning apparatus according to the invention, the amount of the leakage can be kept small. Accordingly, the safety can be improved. Further, the air-conditioning apparatus according to the invention can improve heat transfer efficiency in the second heat exchanger, thereby further contributing to improvement of energy efficiency.

DESCRIPTION OF EMBODIMENT

Embodiment of the invention will be described below with reference to the drawings.

Figure 1:
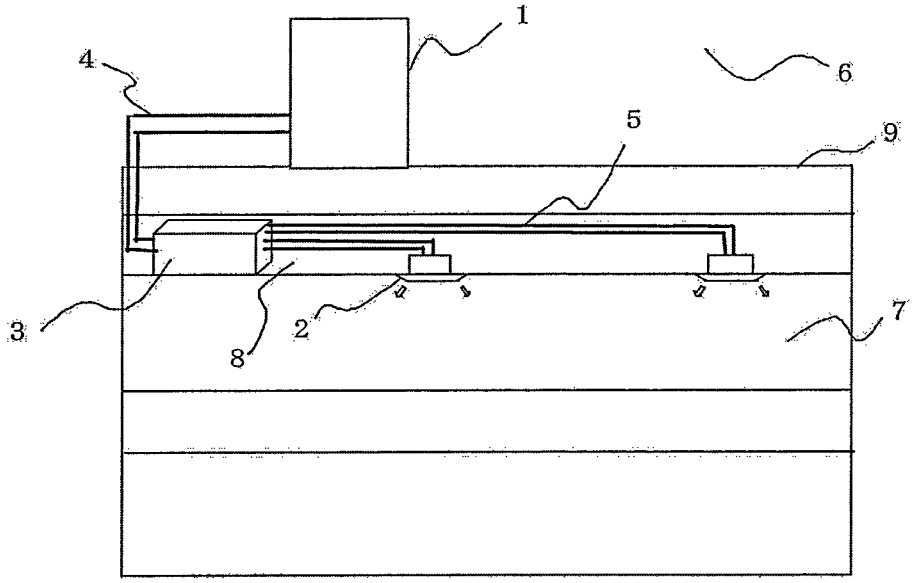
FIG. 1 is a schematic diagram illustrating an exemplary installation of an air-conditioning apparatus according to Embodiment of the invention.

FIG. 1 is a schematic diagram illustrating an exemplary installation of an air-conditioning apparatus according to Embodiment of the invention. The exemplary installation of the air-conditioning apparatus will be described with reference to FIG. 1. This air-conditioning apparatus employs refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. Note that the dimensional relationship among components in FIG. 1 and the other figures may be different from the actual one.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 is connected to the heat medium relay unit 3 with refrigerant pipes 4 through which the heat source side refrigerant is conveyed. The heat medium relay unit 3 is connected to each indoor unit 2 with pipes (heat medium pipes) 5 through which the heat medium is conveyed. Cooling energy or heating energy generated in the outdoor unit 1 is delivered through the heat medium relay unit 3 to the indoor units 2.

The outdoor unit 1 is typically disposed in an outdoor space 6 which is a space (e.g., a roof) outside of a structure 9, such as an office building, and is configured to supply cooling energy or heating energy through the heat medium relay unit 3 to the indoor units 2. Each indoor unit 2 is disposed at a position such that it can supply cooling air or heating air to an indoor space 7, which is a space (e.g., a living room) inside of the structure 9, and is configured to supply the cooling air or heating air to the indoor space 7, as an air-conditioned space. The heat medium relay unit 3 is configured with a housing separated from housings of the outdoor unit 1 and the indoor units 2 such that the heat medium relay unit 3 can be disposed at a position different from those of the outdoor space 6 and the indoor space 7, and is connected to the outdoor unit 1 through the refrigerant pipes 4 and is connected to the indoor units 2 through the pipes 5 to transfer cooling energy or heating energy supplied from the outdoor unit 1 to the indoor units 2.

As illustrated in FIG. 1, in the air-conditioning apparatus according to Embodiment, the outdoor unit 1 is connected to the heat medium relay unit 3 with two refrigerant pipes 4, and the heat medium relay unit 3 is connected to each indoor unit 2 with two pipes 5. As described above, in the air-conditioning apparatus according to Embodiment, each of the units (the outdoor unit 1, the indoor units 2, and the heat medium relay unit 3) is connected with two pipes (the refrigerant pipes 4 or the pipes 5), thus construction is facilitated.

Further, FIG. 1 illustrates a state where the heat medium relay unit 3 is disposed in the structure 9 but in a space different from the indoor space 7, for example, a space above a ceiling (hereinafter, simply referred to as a "space 8"). Therefore, other than the space above the ceiling, the heat medium relay unit 3 may be installed in any space as long as the space is not a living space and is somehow ventilated to outside. For example, it is also possible to install the heat medium relay unit 3 in a space that is a common use space where an elevator or the like is located and is ventilated to outside, or the like. Furthermore, the heat medium relay unit 3 can be disposed near the outdoor unit 1. If the distance between the heat medium relay unit 3 and each indoor unit 2 is too long, the conveyance power for the heat medium becomes considerably large. It should be therefore noted that the energy saving effect is reduced in this case.

FIG. 1 illustrates a case in which the outdoor unit 1 is disposed in the outdoor space 6. The arrangement is not limited to this case. For example, the outdoor unit 1 may be disposed in an enclosed space, for example, a machine room with a ventilation opening, may be disposed inside of the structure 9 as long as waste heat can be exhausted through an exhaust duct to the outside of the structure 9, or may also be disposed inside of the structure 9 in the use of the outdoor unit 1 of a water-cooled type. There is no particular problem when the outdoor unit 1 is disposed in such a place.

Although FIG. 1 illustrates a case in which the indoor units 2 are of a ceiling cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like. Additionally, the numbers of connected outdoor unit 1, indoor units 2, and heat medium relay unit 3 are not limited to those illustrated in FIG. 1. The numbers thereof can be determined in accordance with the structure 9 where the air-conditioning apparatus according to Embodiment is installed.

Figure 2:
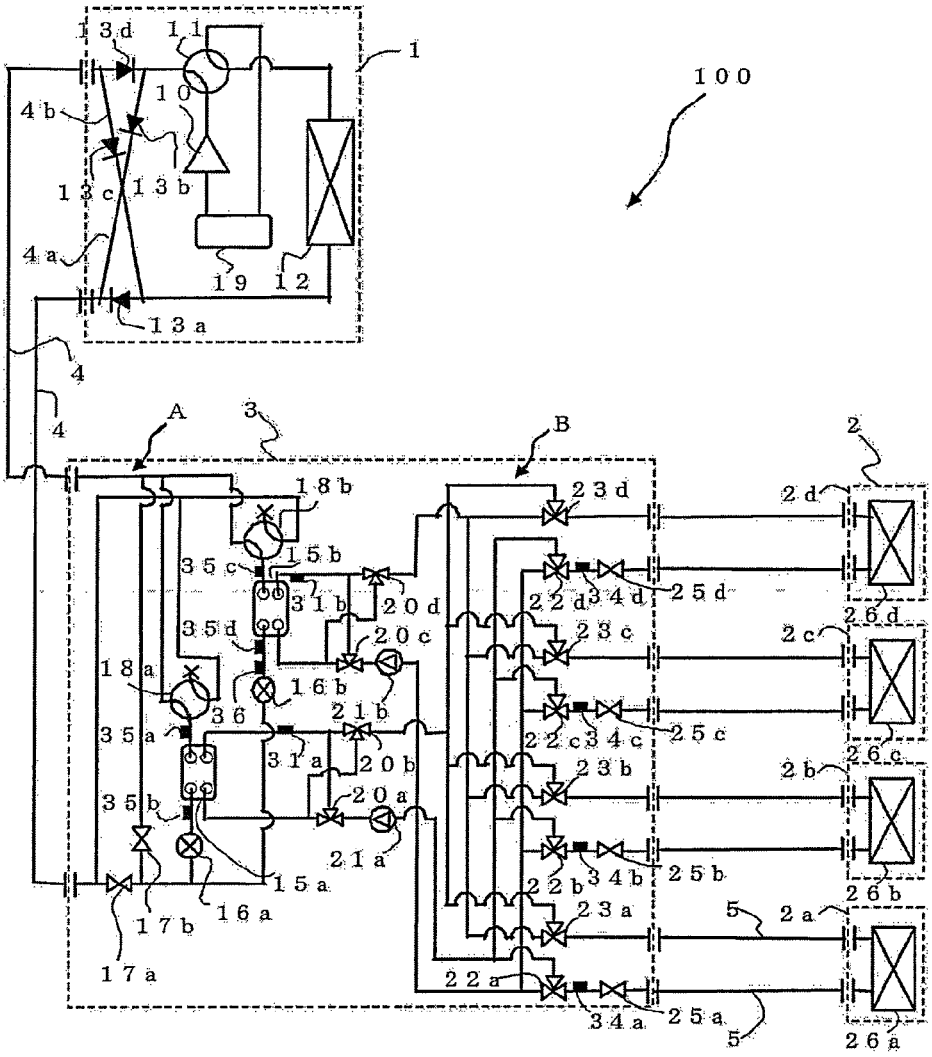
FIG. 2 is a schematic circuit diagram illustrating an exemplary circuit configuration of the air-conditioning apparatus according to Embodiment of the invention.

FIG. 2 is a schematic circuit diagram illustrating an exemplary circuit configuration of the air-conditioning apparatus (hereinafter, referred to as an "air-conditioning apparatus 100") according to Embodiment. The detailed configuration of the air-conditioning apparatus 100 will be described with reference to FIG. 2. As illustrated in FIG. 2, the outdoor unit 1 and the heat medium relay unit 3 are connected with the refrigerant pipes 4 through heat exchangers 15*a* and 15*b* related to heat medium included in the heat medium relay unit 3. Further, the heat medium relay unit 3 and each indoor unit 2 are also connected by the pipes 5 through the heat exchangers 15*a* and 15*b* related to heat medium. Note that the refrigerant pipes 4 will be described in detail later.

[Outdoor Unit 1]

The outdoor unit 1 includes a compressor 10, a first refrigerant flow switching device 11, such as a four-way valve, a heat source side heat exchanger 12 (first heat exchanger), and an accumulator 19, which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the heat source side refrigerant, allowed to flow into the heat medium relay unit 3, to flow in a constant direction irrespective of an operation requested by any indoor unit 2.

The compressor 10 is configured to suction the heat source side refrigerant and compress the heat source side refrigerant to a high temperature, high pressure state, and may be a capacity-controllable inverter compressor, for example. The first refrigerant flow switching device 11 is configured to switch the flow of the heat source side refrigerant between a heating operation (a heating only operation mode and a heating main operation mode) and a cooling operation (a cooling only operation mode and a cooling main operation mode).

The heat source side heat exchanger 12 is configured to function as an evaporator in the heating operation, function as a condenser (or a radiator) in the cooling operation, exchange heat between air, supplied from an air-sending device such as a fan (not illustrated), and the heat source side refrigerant, and evaporate and gasify or condense and liquefy the heat source side refrigerant. The accumulator 19 is disposed on a suction side of the compressor 10 and is configured to store an excess refrigerant caused by the difference between the heating operation and the cooling operation or by transient change in operation.

The check valve 13*d* is provided in the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is provided in the refrigerant pipe 4 positioned between the heat source side heat exchanger 12 and the heat medium relay unit 3 and is configured to permit the heat source side refrigerant to flow only in a predetermined direction (the direction from the outdoor unit 1 to the heat medium relay unit 3). The check valve 13*b* is provided in the first connecting pipe 4*a* and is configured to allow the heat source side refrigerant, discharged from the compressor 10 in the heating operation, to flow to the heat medium relay unit 3. The check valve 13*c* is provided in the second connecting pipe 4*b* and is configured to allow the heat source side refrigerant, returned from the heat medium relay unit 3 in the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. It should be noted that FIG. 2 illustrates a case where the first connecting pipe 4*a*, the second connecting pipe 4*b*, the check valve 13*a*, the check valve 13*b*, the check valve 13*c*, and the check valve 13*d* are arranged, but the arrangement is not limited to this case. It is not necessarily required to arrange these components.

[Indoor Units 2]

The indoor units 2 each include a use side heat exchanger (third heat exchanger) 26. Each of the use side heat exchangers 26 is connected by the pipes 5 to a heat medium flow control device 25 and a second heat medium flow switching device 23 arranged in the heat medium relay unit 3. Each of the use side heat exchangers 26 is configured to exchange heat between air supplied from an air-sending device, such as a fan (not illustrated), and the heat medium in order to generate heating air or cooling air to be supplied to the indoor space 7.

FIG. 2 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIG. 1, the number of connected indoor units 2 illustrated in FIG. 2 is not limited to four.

[Heat Medium Relay Unit 3]

The heat medium relay unit 3 includes the two heat exchangers 15 related to heat medium (second heat exchangers), two expansion devices 16, two opening and closing devices 17, two second refrigerant flow switching devices 18, two pumps 21, four heat medium flow reversing devices 20, four first heat medium flow switching devices 22, the four second heat medium flow control devices 23, and the four heat medium flow control devices 25.

Each of the two heat exchangers 15 related to heat medium (the heat exchanger 15*a* related to heat medium and the heat exchanger 15*b* related to heat medium) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger 15*a* related to heat medium is disposed between an expansion device 16*a* and a second refrigerant flow switching device 18*a* in the refrigerant circuit A and is used to cool the heat medium in the cooling and heating mixed operation mode. Furthermore, the heat exchanger 15*b* related to heat medium is disposed between an expansion device 16*b* and a second refrigerant flow switching device 18*b* in the refrigerant circuit A and is used to heat the heat medium in the cooling and heating mixed operation mode.

The two expansion devices 16 (the expansion device 16*a* and the expansion device 16*b*) each have functions as a reducing valve and an expansion valve and are configured to reduce the pressure of the heat source side refrigerant in order to expand it. The expansion device 16*a* is disposed upstream from the heat exchanger 15*a* related to heat medium in the flow direction of the heat source side refrigerant during the cooling operation. The expansion device 16*b* is disposed upstream from the heat exchanger 15*b* related to heat medium in the flow direction of the heat source side refrigerant during the cooling operation. Each of the two expansion devices 16 may include a component having a variably controllable opening degree, for example, an electronic expansion valve.

The two opening and closing devices 17 (an opening and closing device 17*a* and an opening and closing device 17*b*) each include a two-way valve and the like, and are configured to open or close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side for the heat source side refrigerant and the refrigerant pipe 4 on an outlet side therefor.

The two second refrigerant flow switching devices 18 (the second refrigerant flow switching device 18*a* and the second refrigerant flow switching device 18*b*) each include a four-way valve, for example, and are configured to switch the flow direction of the heat source side refrigerant in accordance with an operation mode. The second refrigerant flow switching device 18*a* is disposed downstream from the heat exchanger 15*a* related to heat medium in the flow direction of the heat source side refrigerant during the cooling operation. The second refrigerant flow switching device 18*b* is disposed downstream from the heat exchanger 15*b* related to heat medium in the flow direction of the heat source side refrigerant in the cooling only operation mode.

The two pumps 21 (a pump 21*a* and a pump 21*b*) are configured to circulate the heat medium conveyed through the pipes 5. The pump 21*a* is disposed in the pipe 5 positioned between heat exchanger 15*a* related to heat medium and the second heat medium flow switching devices 23. The pump 21*b* is disposed in the pipe 5 between the heat exchanger 15*b* related to heat medium and the second heat medium flow switching devices 23. Each of the two pumps 21 may be, for example, a capacity-controllable pump such that a flow rate in the pump can be controlled in accordance with the magnitude of loads in the indoor units 2.

The four heat medium flow reversing devices 20 (heat medium flow reversing devices 20*a* to 20*d*) each include a three-way valve, for example, and switch the flow direction of the heat medium concerning the heat exchanger 15*a* related to heat medium and the heat exchanger 15*b* related to heat medium. Two heat medium flow reversing devices 20 are installed for each heat exchanger 15 related to heat medium. That is, the heat medium flow reversing device (first heat medium flow reversing device) 20*a* and the heat medium flow reversing device (second heat medium flow reversing device) 20*b* are installed for the heat exchanger 15*a* related to heat medium, and the heat medium flow reversing device (first heat medium flow reversing device) 20*c* and the heat medium flow reversing device (second heat medium flow reversing device) 20*d* are installed for the heat exchanger 15*b* related to heat medium.

In the heat medium flow reversing device 20*a*, one of the three ways is connected by a pipe to the pump (heat medium sending device) 21*a*, another one of the three ways is connected by a pipe to one end of the heat exchanger 15*a* related to heat medium, and the other one of the three ways is connected by a pipe to a first connection port in the passage between the other end of the heat exchanger 15*a* related to heat medium and the heat medium flow reversing device 20*b*. In the heat medium flow reversing device 20*b*, one of the three ways is connected by a pipe to the other end of the heat exchanger 15*a* related to heat medium, another one of the three ways is connected by a pipe to a second connection port in the passage between the one end of the heat exchanger 15*a* related to heat medium and the heat medium flow reversing device 20*a*, and the other one of the three ways is connected by a pipe to the second heat medium flow switching devices 23. The heat medium flow reversing device 20*a* and the heat medium flow reversing device 20*b* are controlled in order to switch the flow direction of the heat medium flowing to the heat exchanger 15*a* related to heat medium.

In the heat medium flow reversing device 20*c*, one of the three ways is connected by a pipe to the pump (heat medium sending device) 21*b*, another one of the three ways is connected by a pipe to one end of the heat exchanger 15*b* related to heat medium, and the other one of the three ways is connected by a pipe to a first connection port in the passage between the other end of the heat exchanger 15*b* related to heat medium and the heat medium flow reversing device 20*d*. In the heat medium flow reversing device 20*d*, one of the three ways is connected by a pipe to the other end of the heat exchanger 15*b* related to heat medium, another one of the three ways is connected by a pipe to a second connection port in the passage between the one end of the heat exchanger 15*b* related to heat medium and the heat medium flow reversing device 20*c*, and the other one of the three ways is connected by a pipe to the second heat medium flow switching devices 23. The heat medium flow reversing device 20*c* and the heat medium flow reversing device 20*d* is controlled in order to switch the flow direction of the heat medium flowing to the heat exchanger 15*b* related to heat medium.

The four first heat medium flow switching devices 22 (first heat medium flow switching devices 22*a* to 22*d*) each include, for example, a three-way valve and switches passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding heat medium flow control device 25. Further, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2. Furthermore, switching of the heat medium passage includes not only complete switching from one to the other but also partial switching from one to another.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding use side heat exchanger 26. Further, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2. Furthermore, switching of the heat medium passage includes not only complete switching from one to the other but also partial switching from one to another.

The four heat medium flow control devices 25 (heat medium flow control devices 25*a* to 25*d*) each include a two-way valve capable of controlling the area of an opening and are configured to control a flow rate of the heat medium flowing through the pipe 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. That is, each heat medium flow control device 25 controls the amount of heat medium flowing into the corresponding indoor unit 2 by the temperatures of the heat medium flowing in and flowing out of the indoor unit 2, and thus is capable of supplying the optimum amount of heat medium to the indoor unit 2 in relation to the indoor load.

Note that the heat medium flow control device 25*a*, the heat medium flow control device 25*b*, the heat medium flow control device 25*c*, and the heat medium flow control device 25*d* are illustrated in that order from the bottom of the drawing sheet so as to correspond to the indoor units 2. Further, each heat medium flow control device 25 may be disposed on the inlet side of the heat medium passage of the corresponding use side heat exchanger 26. Furthermore, the heat medium flow control device 25 may be disposed on the inlet side of the heat medium passage of the use side heat exchanger 26 such that the heat medium flow control device 25 is positioned between the second heat medium flow switching device 23 and the use side heat exchanger 26. Moreover, while any load is not needed in the indoor unit 2, for example, during suspension or in thermo-off state, fully closing the heat medium flow control device 25 can stop supply of the heat medium to the indoor unit 2.

The heat medium relay unit 3 includes various detecting means (two first temperature sensors 31, four second temperature sensors 34, four third temperature sensors 35, and a pressure sensor 36). Information (temperature information and pressure information) detected by these detecting means are transmitted to a controller (not illustrated) that performs integrated control of operations of the air-conditioning apparatus 100 such that the information is used to control, for example, a driving frequency of the compressor 10, a rotation speed of each air-sending device (not illustrated), switching by the first refrigerant flow switching device 11, a driving frequency of the pumps 21, switching by the second refrigerant flow switching devices 18, and switching of the heat medium passage, and a flow rate of the heat medium in each indoor unit 2.

Each of the two first temperature sensors 31 (a first temperature sensor 31*a* and a first temperature sensor 31*b*) detects the temperature of the heat medium flowing out of the corresponding heat exchanger 15 related to heat medium, namely, the temperature of the heat medium at an outlet of the corresponding heat exchanger 15 related to heat medium and may include, for example, a thermistor. The first temperature sensor 31*a* is disposed in the pipe 5 on an inlet side of the pump 21*a*. The first temperature sensor 31*b* is disposed in the pipe 5 on the inlet side of the pump 21*b*.

Each of the four second temperature sensors 34 (second temperature sensor 34*a* to 34*d*) is disposed between the corresponding first heat medium flow switching device 22 and heat medium flow control device 25 and detects the temperature of the heat medium flowing out of each use side heat exchanger 26. A thermistor or the like may be used as the second temperature sensor 34. The second temperature sensors 34 are arranged so that the number thereof (four in this case) corresponds to the installed number of indoor units 2. Further, illustrated from the bottom of the drawing are the second temperature sensor 34*a*, the second temperature sensor 34*b*, the second temperature sensor 34*c*, and the second temperature sensor 34*d* so as to correspond to the respective indoor units 2. Furthermore, each second temperature sensor 34 may be disposed in a passage between the heat medium flow control device 25 and the use side heat exchanger 26.

Each of the four third temperature sensors 35 (third temperature sensors 35*a* to 35*d*) is disposed on the inlet side or the outlet side of a heat source side refrigerant of the heat exchanger 15 related to heat medium and detects the temperature of the heat source side refrigerant flowing into the heat exchanger 15 related to heat medium or the temperature of the heat source side refrigerant flowing out of the heat exchanger 15 related to heat medium and may include, for example, a thermistor. The third temperature sensor 35*a* is disposed between the heat exchanger 15*a* related to heat medium and the second refrigerant flow switching device 18*a*. The third temperature sensor 35*b* is disposed between the heat exchanger 15*a* related to heat medium and the expansion device 16*a*. The third temperature sensor 35*c* is disposed between the heat exchanger 15*b* related to heat medium and the second refrigerant flow switching device 18*b*. The third temperature sensor 35*d* is disposed between the heat exchanger 15*b* related to heat medium and the expansion device 16*b*.

The pressure sensor 36 is disposed between the heat exchanger 15*b* related to heat medium and the expansion device 16*b*, similar to the installed position of the third temperature sensor 35*d*, and is configured to detect a pressure of the heat source side refrigerant flowing between the heat exchanger 15*b* related to heat medium and the expansion device 16*b*.

Furthermore, the controller (not illustrated) includes a microcomputer and the like and controls, for example, the driving frequency of the compressor 10, the rotation speed (including ON/OFF) of each air-sending device, switching by the first refrigerant flow switching device 11, driving of the pumps 21, the opening degree of each expansion device 16, opening and closing of each opening and closing device 17, switching by the second refrigerant flow switching devices 18, switching by the heat medium flow reversing devices 20, switching by the first heat medium flow switching devices 22, switching by the second heat medium flow switching devices 23, and driving of the heat medium flow control devices 25 on the basis of the information detected by the various detecting means and instructions from a remote control in order to carry out any of the operation modes which will be described later. Note that the controller may be provided to each unit, or may be provided to the outdoor unit 1 or the heat medium relay unit 3.

The pipes 5 for conveying the heat medium include the pipes connected to the heat exchanger 15*a* related to heat medium and the pipes connected to the heat exchanger 15*b* related to heat medium. Each pipe 5 branches (into four in this case) in accordance with the number of indoor units 2 connected to the heat medium relay unit 3. The pipes 5 are connected with the first heat medium flow switching devices 22 and the second heat medium flow switching devices 23. Controlling each first heat medium flow switching device 22 and each second heat medium flow switching device 23 determines whether the heat medium flowing from the heat exchanger 15*a* related to heat medium is allowed to flow into the corresponding use side heat exchanger 26 and whether the heat medium flowing from the heat exchanger 15*b* related to heat medium is allowed to flow into the corresponding use side heat exchanger 26.

Controlling the heat medium flow reversing device 20 determines the flow direction of the heat medium flowing into the heat exchanger 15*a* related to heat medium or the heat exchanger 15*b* related to heat medium. That is, the flow direction of the heat source side refrigerant and the heat medium can be counter to each other in the heat exchangers 15 related to heat medium by controlling the heat medium flow reversing device 20. Therefore, it is possible to improve heat transfer efficiency in the heat exchangers 15 related to heat medium.

In the air-conditioning apparatus 100, the compressor 10, the first refrigerant flow switching device 11, the heat source side heat exchanger 12, the opening and closing devices 17, the second refrigerant flow switching devices 18, refrigerant passages of the heat exchangers 15 related to heat medium, the expansion devices 16, and the accumulator 19 are connected through the refrigerant pipes 4, thus forming the refrigerant circuit A. In addition, heat medium passages of the heat exchangers 15 related to heat medium, the pumps 21, the heat medium flow reversing devices 20, the first heat medium flow switching devices 22, the heat medium flow control devices 25, the use side heat exchangers 26, and the second heat medium flow switching devices 23 are connected by the pipes 5, thus forming the heat medium circuits B. In other words, the plurality of use side heat exchangers 26 are connected in parallel to each of the heat exchangers 15 related to heat medium, thus turning the heat medium circuit B into a multi-system.

Accordingly, in the air-conditioning apparatus 100, the outdoor unit 1 and the heat medium relay unit 3 are connected through the heat exchanger 15*a* related to heat medium and the heat exchanger 15*b* related to heat medium arranged in the heat medium relay unit 3. The heat medium relay unit 3 and each indoor unit 2 are also connected through the heat exchanger 15*a* related to heat medium and the heat exchanger 15*b* related to heat medium. In other words, in the air-conditioning apparatus 100, the heat exchanger 15*a* related to heat medium and the heat exchanger 15*b* related to heat medium each exchange heat between the heat source side refrigerant circulating in the refrigerant circuit A and the heat medium circulating in the heat medium circuits B.

[Operation Modes]

Various operation modes carried out by the air-conditioning apparatus 100 will be described below. The air-conditioning apparatus 100 allows each indoor unit 2, on the basis of an instruction from the indoor unit 2, to perform a cooling operation or a heating operation. Specifically, the air-conditioning apparatus 100 may allow all of the indoor units 2 to perform the same operation and also allow each of the indoor units 2 to perform different operations.

The operation modes carried out by the air-conditioning apparatus 100 include the cooling only operation mode in which all of the operating indoor units 2 perform the cooling operation, the heating only operation mode in which all of the operating indoor units 2 perform the heating operation, the cooling main operation mode of the cooling and heating mixed operation mode in which a cooling load is larger than a heating load, and the heating main operation mode of the cooling and heating mixed operation mode in which a heating load is larger than a cooling load. The operation modes will be described below with respect to the flow of the heat source side refrigerant and that of the heat medium.

[Cooling Only Operation Mode]

Figure 3:
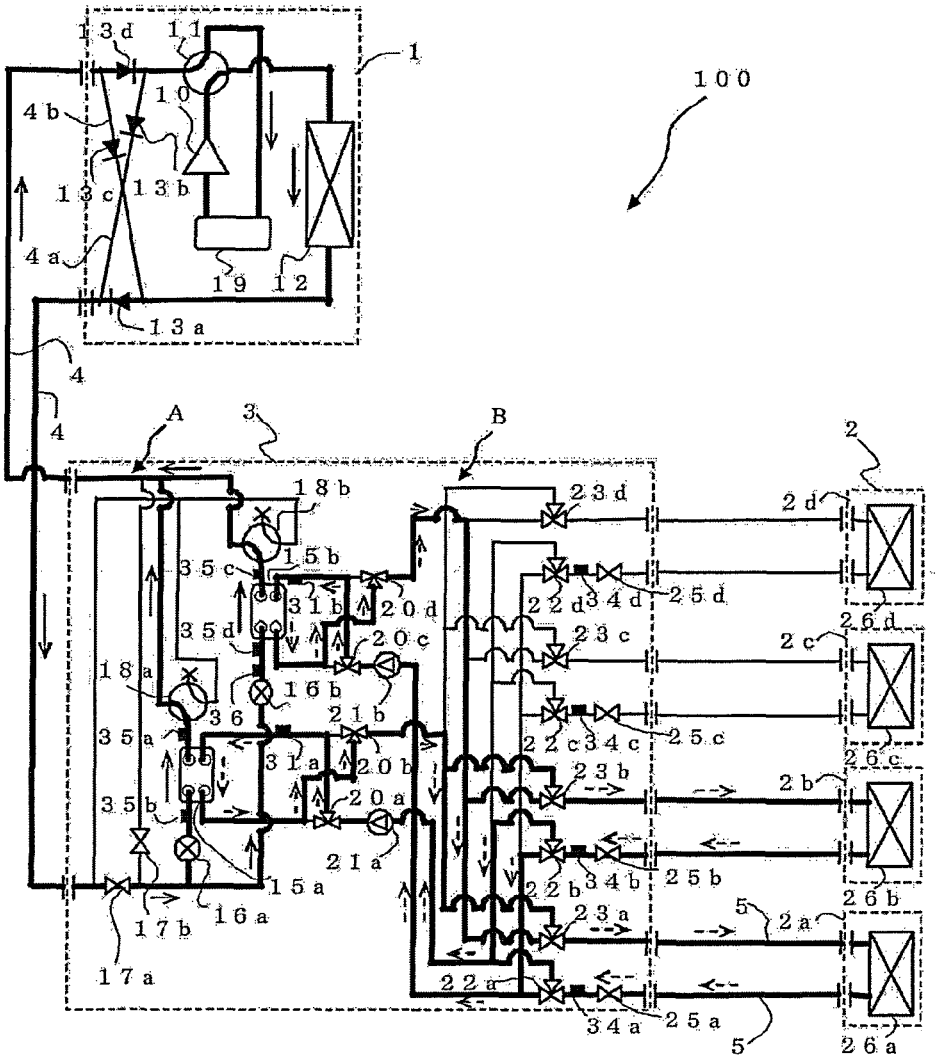
FIG. 3 is a refrigerant circuit diagram illustrating flows of refrigerants in a cooling only operation mode of the air-conditioning apparatus according to Embodiment of the invention.

FIG. 3 is a refrigerant circuit diagram illustrating the flows of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 3. Further, referring to FIG. 3, pipes indicated by thick lines indicate the pipes through which the heat source side refrigerant and the heat medium flow. Furthermore, referring to FIG. 3, solid-line arrows indicate the flow direction of the heat source side refrigerant and broken-line arrows indicate the flow direction of the heat medium.

In the cooling only operation mode illustrated in FIG. 3, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. Then, the refrigerant is condensed and liquefied into a high pressure liquid refrigerant while transferring heat to outdoor air in the heat source side heat exchanger 12. The high pressure liquid refrigerant which has flowed out of the heat source side heat exchanger 12 passes through the check valve 13*a*, flows out of the outdoor unit 1, passes through the refrigerant pipes 4, and flows into the heat medium relay unit 3. The high pressure liquid refrigerant, which has flowed into the heat medium relay unit 3, passes through the opening and closing device 17*a* and is then divided into flows to the expansion device 16*a* and the expansion device 16*b*, in each of which the refrigerant is expanded into a low temperature, low pressure two-phase refrigerant.

This two-phase refrigerant flows into each of the heat exchanger 15*a* related to heat medium and the heat exchanger 15*b* related to heat medium, functioning as evaporators, from the lower side of the drawing, removes heat from the heat medium circulating in the heat medium circuits B, cools the heat medium, and turns into a low temperature, low pressure gas refrigerant. The gas refrigerant, which has flowed out of the upper side of the drawing of each of the heat exchanger 15*a* related to heat medium and the heat exchanger 15*b* related to heat medium, flows out of the heat medium relay unit 3 through the corresponding one of the second refrigerant flow switching device 18*a* and the second refrigerant flow switching device 18*b*, passes through the refrigerant pipe 4, and again flows into the outdoor unit 1. The refrigerant which has flowed into the outdoor unit 1 passes through the check valve 13*d*, the first refrigerant flow switching device 11, and the accumulator 19, and is again suctioned into the compressor 10.

At this time, the opening degree of the expansion device 16*a* is controlled such that superheat (the degree of superheat) obtained as the difference between a temperature detected by the third temperature sensor 35*a* and that detected by the third temperature sensor 35*b* is constant. Similarly, the opening degree of the expansion device 16*b* is controlled such that superheat obtained as the difference between a temperature detected by a third temperature sensor 35*c* and that detected by a third temperature sensor 35*d* is constant. In addition, the opening and closing device 17*a* is opened and the opening and closing device 17*b* is closed.

Next, the flow of the heat medium in the heat medium circuits B will be described.

In the cooling only operation mode, both the heat exchanger 15*a* related to heat medium and the heat exchanger 15*b* related to heat medium transfer cooling energy of the heat source side refrigerant to the heat medium, and the pump 21*a* and the pump 21*b* allow the cooled heat medium to flow through the pipes 5.

At this time, the heat medium which has been pressurized by and flowed out of the pump 21*a* flows into the heat exchanger 15*a* related to heat medium from the upper side of the drawing, via the heat medium flow reversing device 20*a*. Then, the heat medium cooled by the heat source side refrigerant in the heat exchanger 15*a* related to heat medium flows out of the lower side of the drawing of the heat exchanger 15*a* related to heat medium, passes through the heat medium flow reversing device 20*b*, and reaches the second heat medium flow switching device 23*a* and the second heat medium flow switching device 23*b*. The heat medium which has been pressurized by and flowed out of the pump 21*b* flows into the heat exchanger 15*b* related to heat medium from the upper side of the drawing, via the heat medium flow reversing device 20*c*. Then, the heat medium cooled by the heat source side refrigerant in the heat exchanger 15*b* related to heat medium flows out from the lower side of the drawing of the heat exchanger 15*b* related to heat medium, passes through the heat medium flow reversing device 20*d*, and reaches the second heat medium flow switching device 23*a* and the second heat medium flow switching device 23*b*.

The heat medium pressed out of the pump 21*a* and the heat medium pressed out of the pump 21*b* are merged in each of the second heat medium flow switching device 23*a* and the second heat medium flow switching device 23*b* into the corresponding one of the use side heat exchanger 26*a* and the use side heat exchanger 26*b*. The heat medium removes heat from the indoor air in each of the use side heat exchanger 26*a* and the use side heat exchanger 26*b*, and thus cools the indoor space 7. At this time, the use side heat exchanger 26*a* and the use side heat exchanger 26*b* each functions as a cooler, and are preferably configured so that the flow direction of the heat medium and the indoor air (second heat medium) are counter to each other in the use side heat exchanger 26*a* and the use side heat exchanger 26*b*.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*. The heat medium, which has flowed out of each of the heat medium flow control device 25*a* and the heat medium flow control device 25*b*, is branched off in the first heat medium flow switching device 22*a* and the first heat medium flow switching device 22*b* respectively, back into the pump 21*a* and the pump 21*b*.

In the air-conditioning apparatus 100, since the heat medium flow reversing devices 20 are provided, the flow of the heat source side refrigerant and the flow of the heat medium can be counter to each other in the heat exchanger 15*a* related to heat medium and the heat exchanger 15*b* related to heat medium. As illustrated in FIG. 3, in each heat exchanger 15 related to heat medium, the heat source side refrigerant flows from the lower side of the drawing toward the upper side of the drawing, whereas the heat medium flows from the upper side of the drawing toward the lower side of the drawing, so that the flow of the heat source side refrigerant and the flow of the heat medium are counter to each other. Passing the heat source side refrigerant and the heat medium in counterflow improves the heat transfer efficiency and COP.

In a case where a plate heat exchanger is used as each of the heat exchanger 15*a* related to heat medium and the heat exchanger 15*b* related to heat medium, when the heat source side refrigerant on the evaporation side is passed from the lower side to the upper side as illustrated in the drawing, the evaporated gas refrigerant moves to the upper side of the heat exchanger by the buoyancy effect. As a result, the power of the compressor 10 can be reduced, and the refrigerant can appropriately be distributed. In a case where a plate heat exchanger is used as each of the heat exchanger 15*a* related to heat medium and the heat exchanger 15*b* related to heat medium, when the heat medium is passed from the upper side to the lower side as illustrated in the drawing, the cooled heat medium sinks to the lower side of the heat exchanger by the gravitational effect. As a result, the power of the pump 21 can be reduced, and the operation can be more efficient.

Note that in the pipes 5 of each use side heat exchanger 26, the heat medium is directed to flow from the second heat medium flow switching device 23 through the heat medium flow control device 25 to the first heat medium flow switching device 22. Furthermore, the difference between the temperature detected by the first temperature sensor 31*a* or that detected by the first temperature sensor 31*b* and the temperature detected by each of the second temperature sensors 34 is controlled such that the difference is held at a target value, so that the air conditioning load required in the indoor space 7 can be covered. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the corresponding second heat medium flow switching device 23 are set to a medium degree such that passages to both of the heat exchanger 15*a* related to heat medium and the heat exchanger 15*b* related to heat medium are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. Referring to FIG. 3, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding one of heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 4:
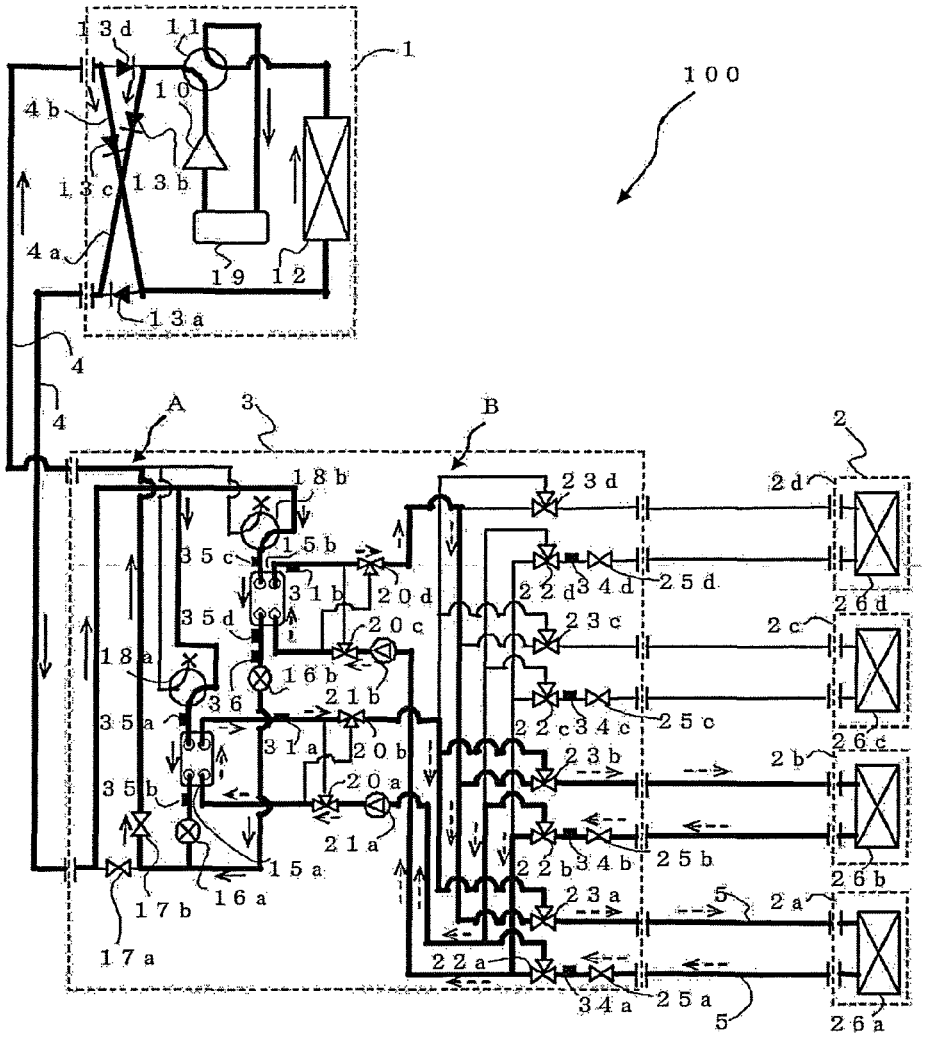
FIG. 4 is a refrigerant circuit diagram illustrating flows of refrigerants in a heating only operation mode of the air-conditioning apparatus according to Embodiment of the invention.

FIG. 4 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 4. Further, referring to FIG. 4, pipes indicated by thick lines indicate the pipes through which the heat source side refrigerant and the heat medium flow. Furthermore, referring to FIG. 4, solid-line arrows indicate the flow direction of the heat source side refrigerant and broken-line arrows indicate the flow direction of the heat medium.

In the heating only operation mode illustrated in FIG. 4, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 passes through the first refrigerant flow switching device 11, flows through the first connecting pipe 4*a*, passes through the check valve 13*b*, and flows out of the outdoor unit 1. The high temperature, high pressure gas refrigerant that has flowed out of the outdoor unit 1 passes through the refrigerant pipe 4 and flows into the heat medium relay unit 3. The high temperature, high pressure gas refrigerant which has flowed into the heat medium relay unit 3 is branched, passes through each of the second refrigerant flow switching device 18*a* and the second refrigerant flow switching device 18*b*, and flows into the corresponding one of the heat exchanger 15*a* related to heat medium and the heat exchanger 15*b* related to heat medium from the upper side of the drawing.

The high temperature, high pressure gas refrigerant which has flowed into each of the heat exchanger 15*a* related to heat medium and the heat exchanger 15*b* related to heat medium from the upper side of the drawing is condensed and liquefied into a high pressure liquid refrigerant while transferring heat to the heat medium circulating in the heat medium circuits B. The liquid refrigerant which has flowed out of the lower side of the drawing of each of the heat exchanger 15*a* related to heat medium and the heat exchanger 15*b* related to heat medium are expanded into a low temperature low pressure, two-phase refrigerant in the corresponding one of the expansion device 16*a* and the expansion device 16*b*. This two-phase refrigerant passes through the opening and closing device 17*b*, flows out of the heat medium relay unit 3, passes through the refrigerant pipe 4, and again flows into the outdoor unit 1. The refrigerant which has flowed into the outdoor unit 1 flows through the second connecting pipe 4*b*, passes through the check valve 13*c*, and flows into the heat source side heat exchanger 12, functioning as an evaporator.

Then, the refrigerant which has flowed into the heat source side heat exchanger 12 removes heat from the outdoor air in the heat source side heat exchanger 12 and thus turns into a low temperature, low pressure gas refrigerant. The low temperature, low pressure gas refrigerant which has flowed out of the heat source side heat exchanger 12 passes through the first refrigerant flow switching device 11 and the accumulator 19 and is suctioned into the compressor 10 again.

At this time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling obtained as the difference between the saturation temperature converted from the pressure detected by the pressure sensor 36 and a temperature detected by the third temperature sensor 35*d*. The opening and closing device 17*a* is closed and the opening and closing device 17*b* is opened. Note that when a temperature at the middle position of the heat exchangers 15 related to heat medium can be measured, the temperature at the middle position may be used instead of the pressure sensor 36. In this case, it is unnecessary to install the pressure sensor 36, thus the system can be established inexpensively.

Next, the flow of the heat medium in the heat medium circuits B will be described.

In the heating only operation mode, both of the heat exchanger 15*a* related to heat medium and the heat exchanger 15*b* related to heat medium transfer heating energy of the heat source side refrigerant to the heat medium and the pump 21*a* and the pump 21*b* allow the heated heat medium to flow through the pipes 5.

At this time, the heat medium which has been pressurized by and flowed out of the pump 21*a* flows into the heat exchanger 15*a* related to heat medium from the lower side of the drawing, via the heat medium flow reversing device 20*a*. Then, the heat medium heated by the heat source side refrigerant in the heat exchanger 15*a* related to heat medium flows out of the upper side of the drawing of the heat exchanger 15*a* related to heat medium, passes through the heat medium flow reversing device 20*b*, and reaches the second heat medium flow switching device 23*a* and the second heat medium flow switching device 23*b*. The heat medium which has been pressurized by and flowed out of the pump 21*b* flows into the heat exchanger 15*b* related to heat medium from the lower side of the drawing, via the heat medium flow reversing device 20*c*. Then, the heat medium heated by the heat source side refrigerant in the heat exchanger 15*b* related to heat medium flows out of the upper side of the drawing of the heat exchanger 15*b* related to heat medium, passes through the heat medium flow reversing device 20*d*, and reaches the second heat medium flow switching device 23*a* and the second heat medium flow switching device 23*b*.

The heat medium pressed out of the pump 21*a* and the heat medium pressed out of the pump 21*b* are merged in each of the second heat medium flow switching device 23*a* and the second heat medium flow switching device 23*b* into the corresponding one of the use side heat exchanger 26*a* and the use side heat exchanger 26*b*. The heat medium transfers heat to the indoor air in each of the use side heat exchanger 26*a* and the use side heat exchanger 26*b*, and thus heats the indoor space 7. At this time, the use side heat exchanger 26*a* and the use side heat exchanger 26*b* each functions as a heater, and are preferably configured so that the flow direction of the heat medium and the indoor air (second heat medium) are counter to each other in the use side heat exchanger 26*a* and the use side heat exchanger 26*b* as is the case in which these use side heat exchangers each function as a cooler.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*. The heat medium, which has flowed out of each of the heat medium flow control device 25*a* and the heat medium flow control device 25*b*, is branched off in the first heat medium flow switching device 22*a* and the first heat medium flow switching device 22*b* respectively, back into the pump 21*a* and the pump 21*b*.

In the air-conditioning apparatus 100, since the heat medium flow reversing devices 20 are provided, the flow of the heat source side refrigerant and the flow of the heat medium can be counter to each other in the heat exchanger 15*a* related to heat medium and the heat exchanger 15*b* related to heat medium. As illustrated in FIG. 4, in each heat exchanger 15 related to heat medium, the heat source side refrigerant flows from the upper side of the drawing toward the lower side of the drawing, whereas the heat medium flows from the lower side of the drawing toward the upper side of the drawing, so that the flow of the heat source side refrigerant and the flow of the heat medium are counter to each other. Passing the heat source side refrigerant and the heat medium in counterflow improves the heat transfer efficiency and COP.

In a case where a plate heat exchanger is used as each of the heat exchanger 15*a* related to heat medium and the heat exchanger 15*b* related to heat medium, when the heat source side refrigerant on the condensation side is passed from the upper side to the lower side as illustrated in the drawing, the condensed liquid refrigerant moves to the lower side of the heat exchanger by the gravitational effect. Thus, the power of the compressor 10 can be reduced. In a case where a plate heat exchanger is used as each of the heat exchanger 15*a* related to heat medium and the heat exchanger 15*b* related to heat medium, when the heat medium is passed from the lower side to the upper side as illustrated in the drawing, the heated heat medium floats to the upper side of the heat exchanger by the buoyancy effect. As a result, the power of the pump 21 can be reduced, and the operation can be more efficient.

Note that in the pipes 5 of each use side heat exchanger 26, the heat medium is directed to flow from the second heat medium flow switching device 23 through the heat medium flow control device 25 to the first heat medium flow switching device 22. Furthermore, the difference between the temperature detected by the first temperature sensor 31*a* or that detected by the first temperature sensor 31*b* and the temperature detected by each of the second temperature sensors 34 is controlled such that the difference is held at a target value, so that the air conditioning load required in the indoor space 7 can be covered. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the corresponding second heat medium flow switching device 23 are set to the medium degree such that passages to both of the heat exchanger 15*a* related to heat medium and the heat exchanger 15*b* related to heat medium are established. Although the use side heat exchanger 26*a* should essentially be controlled on the basis of the difference between a temperature at the inlet and that at the outlet thereof, since a temperature of the heat medium on the inlet side of the use side heat exchanger 26 is substantially the same as the temperature detected by the first temperature sensor 31*b*, the use of the first temperature sensor 31*b* can reduce the number of temperature sensors, so that the system can be established inexpensively.

Upon carrying out the heating only operation mode, since it is unnecessary to supply the heat medium to each use side heat exchanger 26 having no heat load (including thermo-off state), the passage is closed by the corresponding heat medium flow control device 25 such that the heat medium does not flow into the use side heat exchanger 26. Referring to FIG. 4, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding one of heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 5:
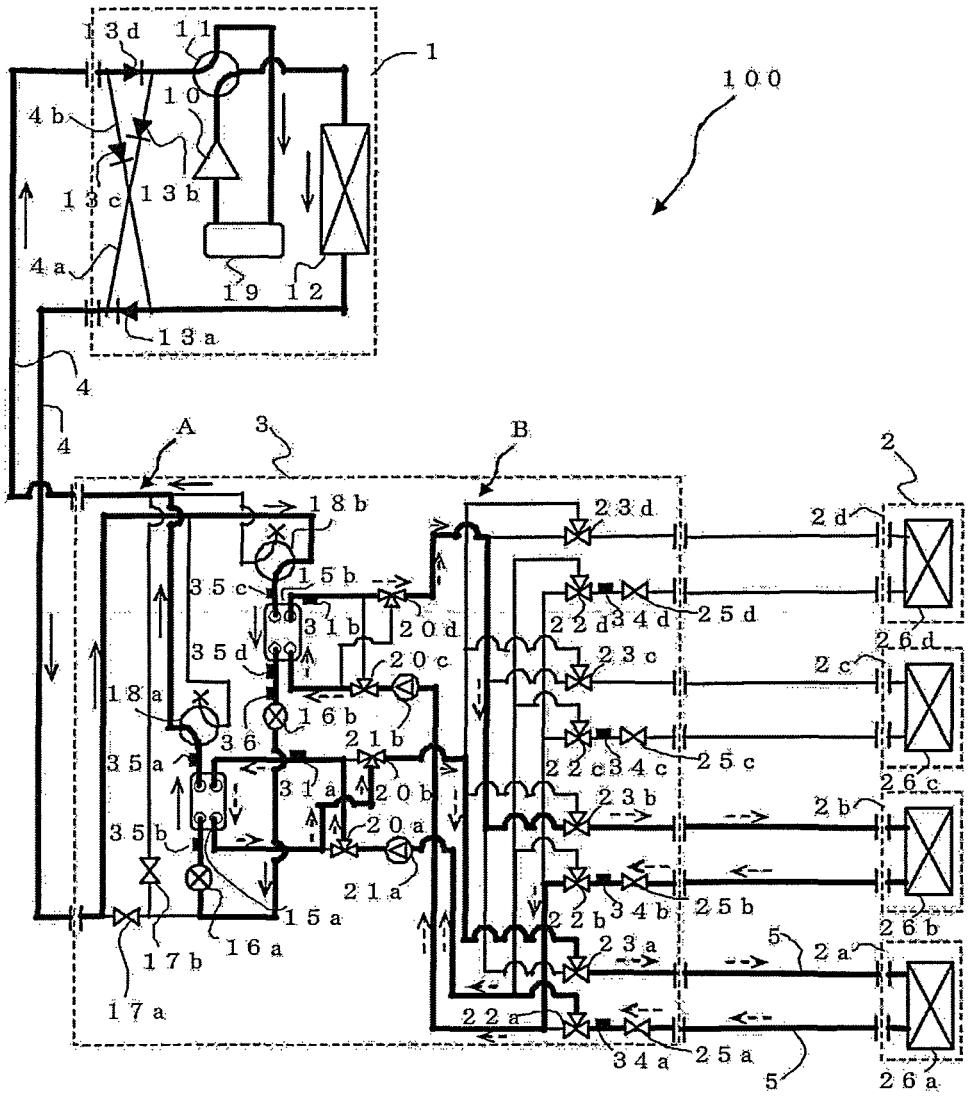
FIG. 5 is a refrigerant circuit diagram illustrating flows of refrigerants in a cooling main operation mode of the air-conditioning apparatus according to Embodiment of the invention.

FIG. 5 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 5. Further, referring to FIG. 5, pipes indicated by thick lines correspond to the pipes through which the heat source side refrigerant and the heat medium circulate. Furthermore, referring to FIG. 5, solid-line arrows indicate the flow direction of the heat source side refrigerant and broken-line arrows indicate the flow direction of the heat medium.

In the cooling main operation mode illustrated in FIG. 5, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger 15*a* related to heat medium and the use side heat exchanger 26*a*, and between the heat exchanger 15*b* related to heat medium and the use side heat exchanger 26*b*.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant, which has flowed out of the heat source side heat exchanger 12, passes through the check valve 13*a*, flows out of the outdoor unit 1, passes through the refrigerant pipe 4, and flows into the heat medium relay unit 3. The two-phase refrigerant, which has flowed into the heat medium relay unit 3, passes through the second refrigerant flow switching device 18*b* and flows into the heat exchanger 15*b* related to heat medium, functioning as a condenser, from the upper side of the drawing.

The two-phase refrigerant that has flowed into the heat exchanger 15*b* related to heat medium from the upper side of the drawing is condensed and liquefied while transferring heat to the heat medium circulating in the heat medium circuits B, and turns into a liquid refrigerant. The liquid refrigerant which has flowed out of the lower side of the drawing of the heat exchanger 15*b* related to heat medium is expanded into a low pressure two-phase refrigerant by the expansion device 16*b*. This low pressure two-phase refrigerant flows through the expansion device 16*a* and into the heat exchanger 15*a* related to heat medium functioning as an evaporator from the lower side of the drawing. The low pressure two-phase refrigerant, which has flowed into the heat exchanger 15*a* related to heat medium from the lower side of the drawing, removes heat from the heat medium circulating in the heat medium circuits B to cool the heat medium, and thus turns into a low pressure gas refrigerant. The gas refrigerant flows out of the upper side of the drawing of the heat exchanger 15*a* related to heat medium, passes through the second refrigerant flow switching device 18*a*, flows out of the heat medium relay unit 3, and flows into the outdoor unit 1 again through the refrigerant pipe 4. The heat source side refrigerant, which has flowed into the outdoor unit 1, passes through the check valve 13*d*, the first refrigerant flow switching device 11 and the accumulator 19, and is then again suctioned into the compressor 10.

At this time, the opening degree of the expansion device 16*b* is controlled such that superheat obtained as the difference between a temperature detected by the third temperature sensor 35*a* and that detected by the third temperature sensor 35*b* is constant. The expansion device 16*a* is fully opened, the opening and closing device 17*a* is closed, and the opening and closing device 17*b* is closed. Note that the opening degree of the expansion device 16*b* may be controlled such that subcooling obtained as the difference between a value indicating a saturation temperature converted from a pressure detected by the pressure sensor 36 and a temperature detected by the third temperature sensor 35*d* is constant. Alternatively, the expansion device 16*b* may be fully opened and the expansion device 16*a* may control the superheat or the subcooling.

Next, the flow of the heat medium in the heat medium circuits B will be described.

In the cooling main operation mode, the heat exchanger 15*b* related to heat medium transfers heating energy of the heat source side refrigerant to the heat medium, and the pump 21*b* allows the heated heat medium to flow through the pipes 5. Furthermore, in the cooling main operation mode, the heat exchanger 15*a* related to heat medium transfers cooling energy of the heat source side refrigerant to the heat medium, and the pump 21*a* allows the cooled heat medium to flow through the pipes 5.

The heat medium which has been pressurized by and flowed out of the pump 21*b* flows into the heat exchanger 15*b* related to heat medium from the lower side of the drawing via the heat medium flow reversing device 20*c*. Then, the heat medium heated by the heat source side refrigerant in the heat exchanger 15*b* related to heat medium flows out of the upper side of the drawing of the heat exchanger 15*b* related to heat medium, passes through the heat medium flow reversing device 20*d*, and reaches the second heat medium flow switching device 23*b*. The heat medium which has been pressurized by and flowed out of the pump 21*a* flows into the heat exchanger 15*a* related to heat medium from the upper side of the drawing, via the heat medium flow reversing device 20*a*. Then, the heat medium cooled by the heat source side refrigerant in the heat exchanger 15*a* related to heat medium flows out of the lower side of the drawing of the heat exchanger 15*a* related to heat medium, passes through the heat medium flow reversing device 20*b*, and reaches the second heat medium flow switching device 23*a*.

The heat medium which has passed through the second heat medium flow switching device 23*b* flows into the use side heat exchanger 26*b*, and transfers heat to the indoor air, thereby heating the indoor space 7. The heat medium which has passed through the second heat medium flow switching device 23*a* flows into the use side heat exchanger 26*a*, and removes heat from the indoor air, thereby cooling the indoor space 7. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*.

The heat medium, which has passed through the use side heat exchanger 26*b* with a slight decrease of temperature, passes through the heat medium flow control device 25*b* and the first heat medium flow switching device 22*b* and is suctioned into the pump 21*b* again. The heat medium, which has passed through the use side heat exchanger 26*a* with a slight increase of temperature, passes through the heat medium flow control device 25*a* and the first heat medium flow switching device 22*a*, and is again suctioned into the pump 21*a*. At this time, the use side heat exchanger 26*a* functions as a cooler and the use side heat exchanger 26*b* functions as a heater, and they are preferably configured so that the flow direction of the heat medium and the indoor air are counter to each other in the use side heat exchanger 26*a* and the use side heat exchanger 26*b*.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between a temperature detected by the first temperature sensor 31*b* and that detected by each of the second temperature sensors 34 is controlled such that the difference is held at a target value, so that the air conditioning load required in the indoor space 7 for heating can be covered. The difference between a temperature detected by each of the second temperature sensors 34 and that detected by the first temperature sensor 31*a* is controlled such that the difference is held at a target value, so that the air conditioning load required in the indoor space 7 for cooling can be covered.

In the air-conditioning apparatus 100, since the heat medium flow reversing devices 20 are provided, the flow of the heat source side refrigerant and the flow of the heat medium can be counter to each other in each of the heat exchanger 15*a* related to heat medium functioning as a cooler and the heat exchanger 15*b* related to heat medium functioning as a heater. As illustrated in FIG. 5, in the heat exchanger 15*a* related to heat medium, the heat source side refrigerant flows from the lower side of the drawing toward the upper side of the drawing, whereas the heat medium flows from the upper side of the drawing toward the lower side of the drawing, and in the heat exchanger 15*b* related to heat medium, the heat source side refrigerant flows from the upper side of the drawing toward the lower side of the drawing, whereas the heat medium flows from the lower side of the drawing toward the upper side of the drawing, so that the flow of the heat source side refrigerant and the flow of the heat medium are counter to each other. Passing the heat source side refrigerant and the heat medium in counterflow improves the heat transfer efficiency and COP.

In a case where a plate heat exchanger is used as the heat exchanger 15*a* related to heat medium functioning as a cooler, when the heat source side refrigerant on the evaporation side is passed from the lower side to the upper side as illustrated in the drawing, the evaporated gas refrigerant moves to the upper side of the heat exchanger by the buoyancy effect. As a result, the power of the compressor 10 can be reduced, and the refrigerant can appropriately be distributed. In a case where a plate heat exchanger is used as the heat exchanger 15*a* related to heat medium functioning as a cooler, when the heat medium is passed from the upper side to the lower side as illustrated in the drawing, the cooled heat medium sinks to the lower side of the heat exchanger by the gravitational effect. As a result, the power of the pump 21 can be reduced, and the operation can be more efficient.

Further in a case where a plate heat exchanger is used as the heat exchanger 15*b* related to heat medium functioning as a heater, when the heat source side refrigerant on the condensation side is passed from the upper side to the lower side as illustrated in the drawing, the condensed liquid refrigerant moves to the lower side of the heat exchanger by the gravitational effect. Thus, the power of the compressor 10 can be reduced. In a case where a plate heat exchanger is used as the heat exchanger 15*b* related to heat medium, when the heat medium is passed from the lower side to the upper side as illustrated in the drawing, the heated heat medium floats to the upper side of the heat exchanger by the buoyancy effect. As a result, the power of the pump 21 can be reduced, and the operation can be more efficient.

Upon carrying out the cooling main operation mode, since it is unnecessary to supply the heat medium to each use side heat exchanger 26 having no heat load (including thermo-off state), the passage is closed by the corresponding heat medium flow control device 25 such that the heat medium does not flow into the use side heat exchanger 26. In FIG. 5, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 6:
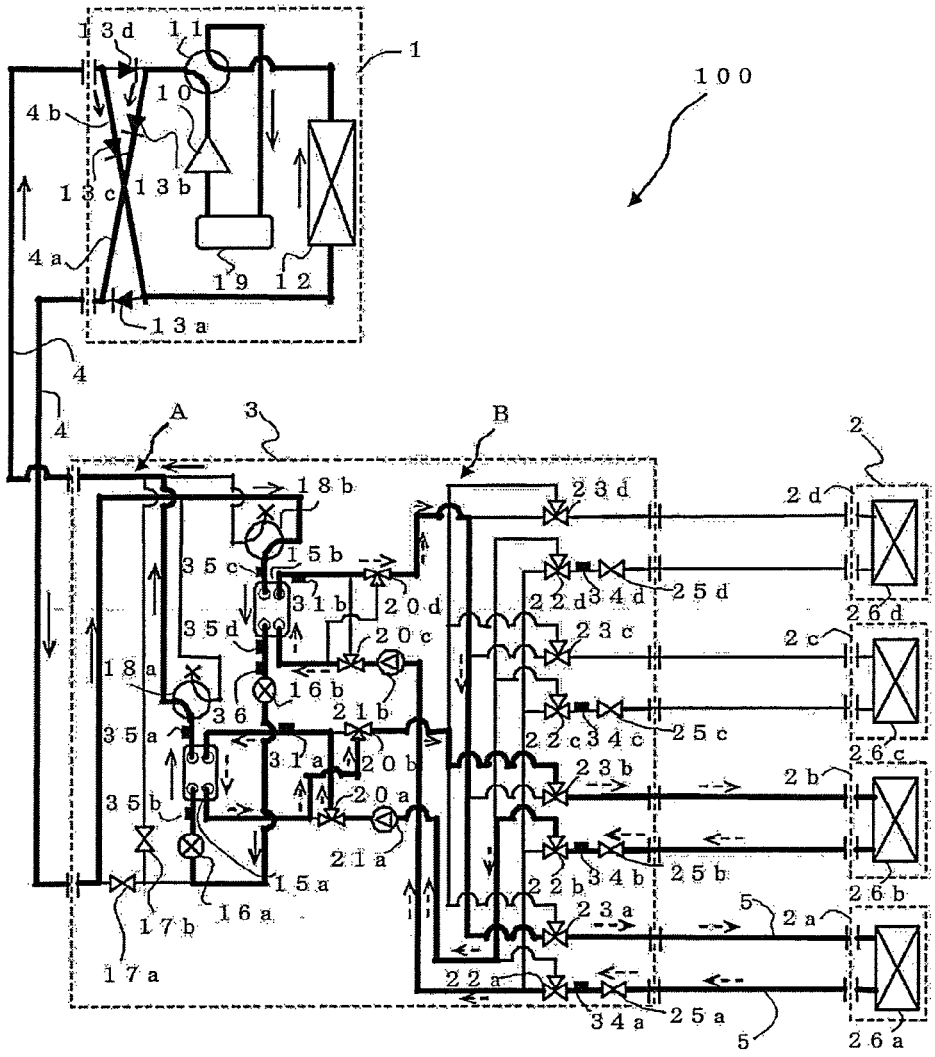
FIG. 6 is a refrigerant circuit diagram illustrating flows of refrigerants in a heating main operation mode of the air-conditioning apparatus according to Embodiment of the invention.

FIG. 6 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 6. Further, referring to FIG. 5, pipes indicated by thick lines correspond to the pipes through which the heat source side refrigerant and the heat medium circulate. Furthermore, referring to FIG. 6, solid-line arrows indicate the flow direction of the heat source side refrigerant and broken-line arrows indicate the flow direction of the heat medium.

In the heating main operation mode illustrated in FIG. 6, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger 15*a* related to heat medium and the use side heat exchanger 26*b* and also circulates between the heat exchanger 15*a* related to heat medium and the use side heat exchanger 26*b*.

First, the flow of the heat source side refrigerant in the refrigerant circuit A will be described.

A low temperature, low pressure refrigerant is compressed by the compressor 10 and is discharged as a high temperature, high pressure gas refrigerant therefrom. The high temperature, high pressure gas refrigerant discharged from the compressor 10 passes through the first refrigerant flow switching device 11, flows through the first connecting pipe 4*a*, passes through the check valve 13*b*, and flows out of the outdoor unit 1. The high temperature, high pressure gas refrigerant that has flowed out of the outdoor unit 1 passes through the refrigerant pipe 4 and flows into the heat medium relay unit 3. The high temperature, high pressure gas refrigerant, which has flowed into the heat medium relay unit 3, passes through the second refrigerant flow switching device 18*b* and flows into the heat exchanger 15*b* related to heat medium, functioning as a condenser, from the upper side of the drawing.

The gas refrigerant which has flowed into the heat exchanger 15*b* related to heat medium from the upper side of the drawing is condensed and liquefied while transferring heat to the heat medium circulating in the heat medium circuits B, and turns into a liquid refrigerant. The liquid refrigerant which has flowed out of the lower side of the heat exchanger 15*b* related to heat medium is expanded into a low pressure two-phase refrigerant by the expansion device 16*b*. This low pressure two-phase refrigerant flows through the expansion device 16*a* and into the heat exchanger 15*a* related to heat medium functioning as an evaporator from the lower side of the drawing. The low pressure two-phase refrigerant which has flowed into the heat exchanger 15*a* related to heat medium from the lower side of the drawing removes heat from the heat medium circulating in the heat medium circuits B and is evaporated to cool the heat medium. This low pressure two-phase refrigerant flows out of the upper side of the drawing of the heat exchanger 15*a* related to heat medium, passes through the second refrigerant flow switching device 18*a*, flows out of the heat medium relay unit 3, and flows into the outdoor unit 1 again through the refrigerant pipe 4.

The heat source side refrigerant, which has flowed into the outdoor unit 1, flows through the check valve 13*c* into the heat source side heat exchanger 12, functioning as an evaporator. The refrigerant, which has flowed into the heat source side heat exchanger 12, removes heat from the outdoor air in the heat source side heat exchanger 12, such that it turns into a low temperature, low pressure gas refrigerant. The low temperature, low pressure gas refrigerant which has flowed out of the heat source side heat exchanger 12 passes through the first refrigerant flow switching device 11 and the accumulator 19 and is suctioned into the compressor 10 again.

At this time, the opening degree of the expansion device 16*b* is controlled such that subcooling obtained as the difference between a value indicating a saturation temperature converted from a pressure detected by the pressure sensor 36 and a temperature detected by the third temperature sensor 35*b* is constant. The expansion device 16*a* is fully opened, the opening and closing device 17*a* is closed, and the opening and closing device 17*b* is closed. Note that, the expansion device 16*b* may be fully opened and the expansion device 16*a* may control the subcooling.

Next, the flow of the heat medium in the heat medium circuits B will be described.

In the heating main operation mode, the heat exchanger 15*b* related to heat medium transfers heating energy of the heat source side refrigerant to the heat medium and the pump 21*b* allows the heated heat medium to flow through the pipes 5. Furthermore, in the heating main operation mode, the heat exchanger 15*a* related to heat medium transfers cooling energy of the heat source side refrigerant to the heat medium and the pump 21*a* allows the cooled heat medium to flow through the pipes 5.

The heat medium which has been pressurized by and flowed out of the pump 21*b* flows into the heat exchanger 15*b* related to heat medium from the lower side of the drawing via the heat medium flow reversing device 20*c*.

Then, the heat medium heated by the heat source side refrigerant in the heat exchanger 15*b* related to heat medium flows out of the upper side of the drawing of the heat exchanger 15*b* related to heat medium, passes through the heat medium flow reversing device 20*d*, and reaches the second heat medium flow switching device 23*a*. The heat medium which has been pressurized by and flowed out of the pump 21*a* flows into the heat exchanger 15*a* related to heat medium from the upper side of the drawing, via the heat medium flow reversing device 20*a*. Then, the heat medium cooled by the heat source side refrigerant in the heat exchanger 15*a* related to heat medium flows out of the lower side of the drawing of the heat exchanger 15*a* related to heat medium, passes through the heat medium flow reversing device 20*b*, and reaches the second heat medium flow switching device 23*b*.

The heat medium which has passed through the second heat medium flow switching device 23*a* flows into the use side heat exchanger 26*a*, and transfers heat to the indoor air, thereby heating the indoor space 7. The heat medium which has passed through the second heat medium flow switching device 23*b* flows into the use side heat exchanger 26*b*, and removes heat from the indoor air, thereby cooling the indoor space 7. At this time, each of the heat medium flow control device 25*a* and the heat medium flow control device 25*b* controls a flow rate of the heat medium as necessary to cover an air conditioning load required in the indoor space such that the controlled flow rate of the heat medium flows into the corresponding one of the use side heat exchanger 26*a* and the use side heat exchanger 26*b*.

The heat medium, which has passed through the use side heat exchanger 26*a* with a slight decrease of temperature, passes through the heat medium flow control device 25*a* and the first heat medium flow switching device 22*a*, and is again suctioned into the pump 21*b*. The heat medium, which has passed through the use side heat exchanger 26*b* with a slight increase of temperature, passes through the heat medium flow control device 25*b* and the first heat medium flow switching device 22*b*, and is again suctioned into the pump 21*a*. At this time, the use side heat exchanger 26*a* functions as a heater and the use side heat exchanger 26*b* functions as a cooler, and they are preferably configured so that the flow directions of the heat medium and the indoor air are counter to each other in the use side heat exchanger 26*a* and the use side heat exchanger 26*b*.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between a temperature detected by the first temperature sensor 31*b* and that detected by each of the second temperature sensors 34 is controlled such that the difference is held at a target value, so that the air conditioning load required in the indoor space 7 for heating can be covered. The difference between a temperature detected by each of the second temperature sensors 34 and that detected by the first temperature sensor 31*a* is controlled such that the difference is held at a target value, so that the air conditioning load required in the indoor space 7 for cooling can be covered.

In the air-conditioning apparatus 100, since the heat medium flow reversing devices 20 are provided, the flow of the heat source side refrigerant and the flow of the heat medium can be counter to each other in each of the heat exchanger 15*a* related to heat medium functioning as a cooler and the heat exchanger 15*b* related to heat medium functioning as a heater. As illustrated in FIG. 6, in the heat exchanger 15*a* related to heat medium, the heat source side refrigerant flows from the lower side of the drawing toward the upper side of the drawing, whereas the heat medium flows from the upper side of the drawing toward the lower side of the drawing, and in the heat exchanger 15*b* related to heat medium, the heat source side refrigerant flows from the upper side of the drawing toward the lower side of the drawing, whereas the heat medium flows from the lower side of the drawing toward the upper side of the drawing, so that the flow of the heat source side refrigerant and the flow of the heat medium are counter to each other. Passing the heat source side refrigerant and the heat medium in counterflow improves the heat transfer efficiency and COP.

In a case where a plate heat exchanger is used as the heat exchanger 15*a* related to heat medium functioning as a cooler, when the heat source side refrigerant on the evaporation side is passed from the lower side to the upper side as illustrated in the drawing, the evaporated gas refrigerant moves to the upper side of the heat exchanger by the buoyancy effect. As a result, the power of the compressor 10 can be reduced, and the refrigerant can appropriately be distributed. In a case where a plate heat exchanger is used as the heat exchanger 15*a* related to heat medium functioning as a cooler, when the heat medium is passed from the upper side to the lower side as illustrated in the drawing, the cooled heat medium sinks to the lower side of the heat exchanger by the gravitational effect. As a result, the power of the pump 21 can be reduced, and the operation can be more efficient.

In a case where a plate heat exchanger is used as each of the heat exchanger 15*a* related to heat medium and the heat exchanger 15*b* related to heat medium, when the heat source side refrigerant on the condensation side is passed from the upper side to the lower side as illustrated in the drawing, the condensed liquid refrigerant moves to the lower side of the heat exchanger by the gravitational effect. Thus, the power of the compressor 10 can be reduced. In a case where a plate heat exchanger is used as the heat exchanger 15*b* related to heat medium, when the heat medium is passed from the lower side to the upper side as illustrated in the drawing, the heated heat medium floats to the upper side of the heat exchanger by the buoyancy effect. As a result, the power of the pump 21 can be reduced, and the operation can be more efficient.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. Referring to FIG. 6, the heat medium flows into the use side heat exchanger 26*a* and the use side heat exchanger 26*b* because these use side heat exchangers each have a heat load. The use side heat exchanger 26*c* and the use side heat exchanger 26*d* have no heat load and the corresponding one of heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Specific Example of Heat Medium Flow Reversing Device 20]

Figure 13:
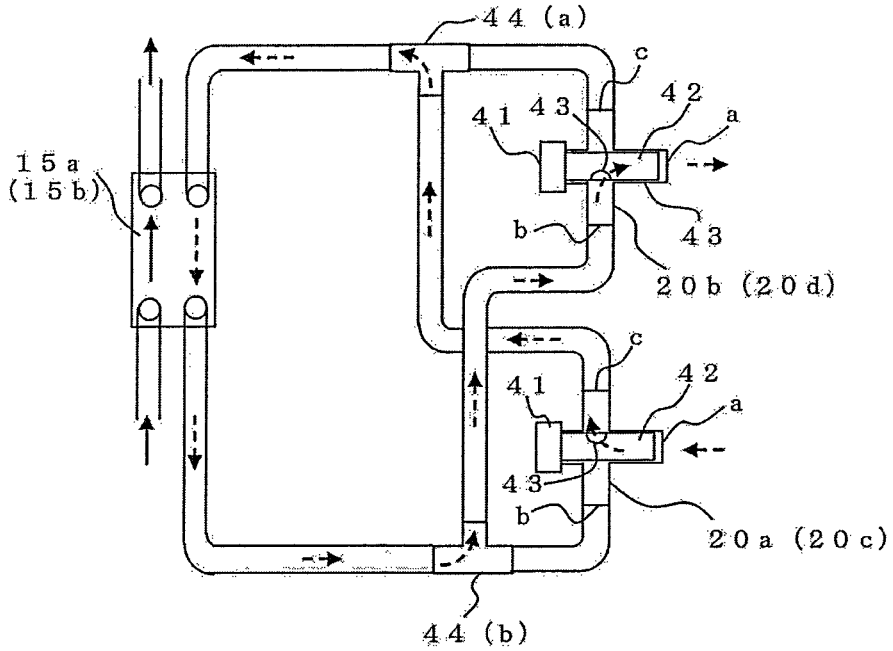
FIG. 13 specifically illustrates the configuration of a heat medium flow reversing device, and illustrates a part of the heat medium relay unit illustrated in FIG. 2 in enlarged view.
Figure 14:
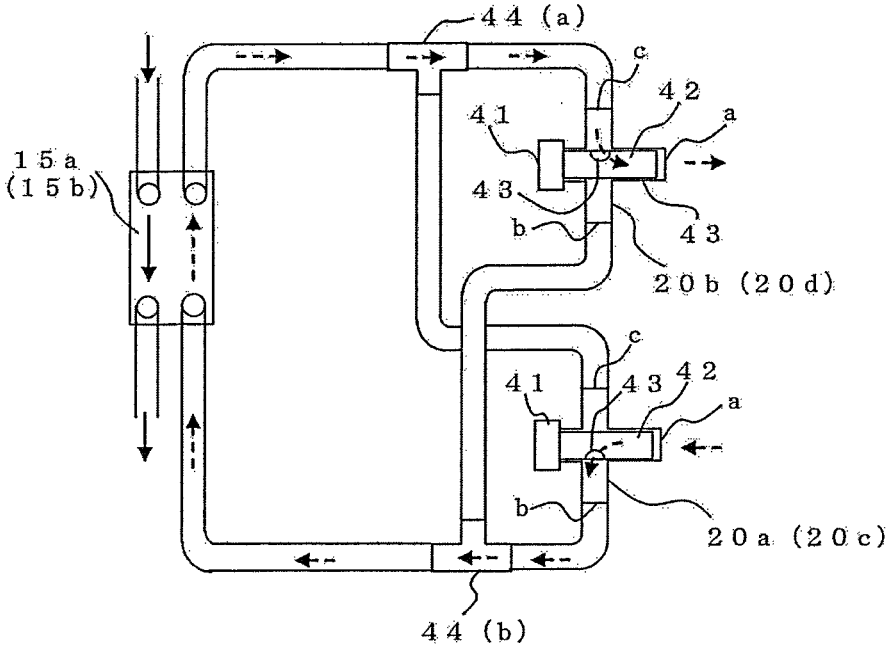
FIG. 14 specifically illustrates the configuration of a heat medium flow reversing device, and illustrates a part of the heat medium relay unit illustrated in FIG. 2 in enlarged view.

FIGS. 13 and 14 each illustrate the configuration of the heat medium flow reversing device 20 specifically, and illustrate a part of the heat medium relay unit illustrated in FIG. 2 in enlarged view. The specific configuration of the heat medium flow reversing device 20 will be described with reference to FIGS. 13 and 14. FIGS. 13 and 14 each illustrate the connecting part between the heat exchanger 15 related to heat medium, and the heat medium flow reversing device 20 connected to the heat exchanger 15 related to heat medium in enlarged view. The heat medium flow reversing devices 20*a* to 20*d* may be collectively referred to as heat medium flow reversing device 20. Furthermore, referring to FIGS. 13 and 14, solid-line arrows indicate the flow direction of the heat source side refrigerant and broken-line arrows indicate the flow direction of the heat medium.

The heat medium flow reversing device 20 is configured so that by rotating a cylindrical rotary tube 42, whose inside is hollowed, by a motor 41 such as a stepping motor, the position of a hole 43 having, for example, an elliptical or circular shape provided in the side of the rotary tube 42 is varied in the circumferential direction, thereby allowing the heat medium to flow between a connection port a connected to an end of the rotary tube 42, and a connection port b or connection port c each connected to the side part of the rotary tube 42.

While FIG. 13 illustrates a case where the heat exchanger 15*a* related to heat medium cools the heat medium (the cooling only operation mode, the cooling main operation mode, or the heating main operation mode), the operation is the same also for the heat exchanger 15*b* related to heat medium.

Further, while FIG. 14 illustrates a case where the heat exchanger 15*a* related to heat medium heats the heat medium (the heating only operation mode), the operation is the same also for the heat exchanger 15*b* related to heat medium.

The operation in a case where the heat exchanger 15*a* related to heat medium cools the heat medium will be described with reference to FIG. 13.

The heat medium sent from the pump 21*a* (not illustrated) flows into the heat medium flow reversing device 20*a* from the end a of the heat medium flow reversing device 20*a*. The heat medium which has flowed from the end a flows into the inside of the rotary tube 42 of the heat medium flow reversing device 20*a*, flows in the inside of the rotary tube 42, and flows out of the hole 43 provided in the side face of the rotary tube 42. At this time, the hole 43 of the heat medium flow reversing device 20*a* communicates with the connection port c connected to the side part of the rotary tube 42, and the heat medium which has flowed out of the hole 43 exits from the connection port c connected to the side part of the rotary tube 42.

Then, via a joint 44(*a*), the heat medium flows into the heat exchanger 15*a* related to heat medium from the upper part of the drawing, flows out of the lower part of the drawing of the heat exchanger 15*a* related to heat medium, and via a joint 44(*b*), the heat medium flows into the heat medium flow reversing device 20*b* from the connection port b connected to the side part of the rotary tube 42 of the heat medium flow reversing device 20*b*. The hole 43 is located at the connection port b in the heat medium flow reversing device 20*b*. The heat medium flows into the inside of the rotary tube 42 from the hole 43 provided in the side face of the rotary tube 42, flows inside the rotary tube 42, and flows out of the end a of the rotary tube 42. At this time, in the heat exchanger 15*a* related to heat medium, the refrigerant flows from the lower part to the upper part of the drawing, and the refrigerant and the heat medium are in counterflow.

Next, the operation in a case where the heat exchanger 15*a* related to heat medium heats the heat medium will be described with reference to FIG. 14.

The heat medium sent from the pump 21*a* (not illustrated) flows into the heat medium flow reversing device 20*a* from the end a of the heat medium flow reversing device 20*a*. The heat medium which has flowed from the end a flows into the inside of the rotary tube 42 of the heat medium flow reversing device 20*a*, flows in the inside of the rotary tube 42, and flows out of the hole 43 provided in the side face of the rotary tube 42. At this time, the hole 43 of the heat medium flow reversing device 20*a* communicates with the connection port c connected to the side part of the rotary tube 42, and the heat medium which has flowed out of the hole 43 exits from the connection port c connected to the side part of the rotary tube 42.

Then, via a joint 44(*b*), the heat medium flows into the heat exchanger 15*a* related to heat medium from the lower part of the drawing, flows out of the upper part of the drawing of the heat exchanger 15*a* related to heat medium, and via a joint 44(*a*), the heat medium flows into the heat medium flow reversing device 20*b* from the connection port c connected to the side part of the rotary tube 42 of the heat medium flow reversing device 20*b*. The hole 43 is located at the connection port c in the heat medium flow reversing device 20*b*. The heat medium flows into the inside of the rotary tube 42 from the hole 43 provided in the side face of the rotary tube 42, flows inside the rotary tube 42, and flows out of the end a of the rotary tube 42. At this time, in the heat exchanger 15*a* related to heat medium, the refrigerant flows from the upper part to the lower part of the drawing, and the refrigerant and the heat medium are in counterflow.

As described above, in both cooling and heating, the heat medium flow reversing device is configured such that the heat medium flows out of an end of the rotary tube 42 of one heat medium flow reversing device 20, and flows out of the other end of the rotary tube 42 of the other heat medium flow reversing device 20. In the heat medium flow reversing device 20*a* on the inlet side, the heat medium flows out from the inside of the rotary tube 42 to the side face of the rotary tube 42, and in the heat medium flow reversing device 20*b* on the outlet side, the heat medium flows out from the side face of the rotary tube 42 to the inside of the rotary tube 42.

FIGS. 13 and 14 illustrate that the motor 41 and the rotary tube 42 are arranged horizontally in each of the heat medium flow reversing device 20*a* and the heat medium flow reversing device 20*b*, but the arrangement is not limited to this. The motor 41 and the rotary tube 42 may be installed vertically.

The joint 44(*a*) and the joint 44(*b*) each may be a joint including a three-way passage such as a T-joint. However, the joint 44(*a*) and the joint 44(*b*) may not necessarily be provided, and a machining method such as boring a hole in the side face of a pipe, and inserting and securing another pipe in place may alternatively employed.

While the case where a single heat medium flow reversing device 20 is installed on each of the inlet side and outlet side of the heat exchanger 15 related to heat medium, the arrangement is not limited to this case. The configuration may be such that a plurality of heat medium flow reversing devices 20 are installed, which are divided into two sets of heat medium flow reversing devices 20 that perform the same operation within each single set.

[Another Exemplary Configuration of Air-Conditioning Device 100]

Figure 7:
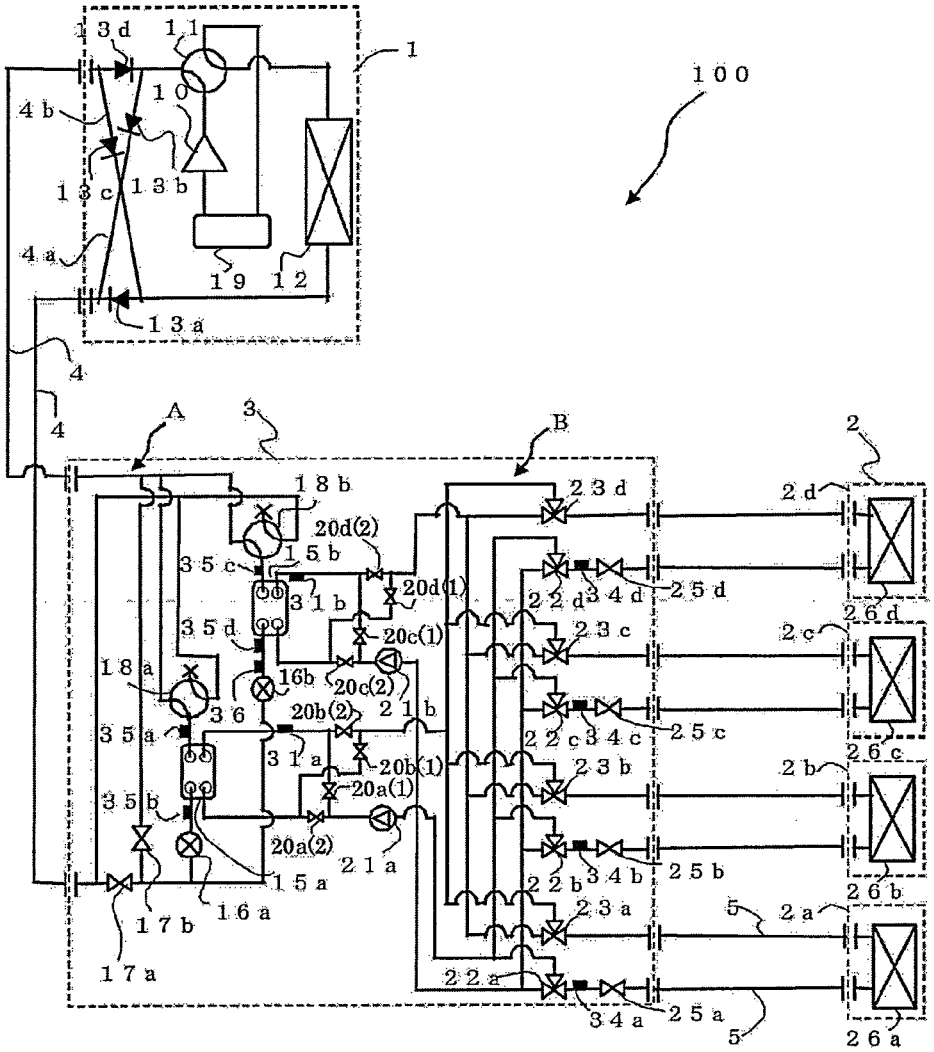
FIG. 7 is another schematic circuit diagram illustrating an exemplary circuit configuration of the air-conditioning apparatus according to Embodiment of the invention.

FIG. 7 is a schematic circuit diagram illustrating another exemplary circuit configuration of the air-conditioning apparatus 100 according to Embodiment. While FIGS. 2 to 6 describe the example in which the heat medium flow reversing devices 20 each include a three-way valve and can switch the heat medium passage in three ways, FIG. 7 illustrates an example in which the heat medium flow reversing devices 20 each include an on-off valve such as a two-way valve, and switching operations of the heat medium passage in two ways are combined. Otherwise, there is no difference in configuration.

That is, as illustrated in FIG. 7, each of the heat medium flow reversing devices 20 may include two on-off valves, thereby enabling switching of the heat medium passage. In this case, the heat medium flow reversing device 20*a* includes an on-off valve 20*a*(1) and an on-off valve 20*a*(2), the heat medium flow reversing device 20*b* includes an on-off valve 20*b*(1) and an on-off valve 20*b*(2), the heat medium flow reversing device 20*c* includes an on-off valve 20*c*(1) and an on-off valve 20*c*(2), and the heat medium flow reversing device 20*d* includes an on-off valve 20*d*(1) and an on-off valve 20*d*(2).

When the air-conditioning apparatus 100 is configured as described above, any refrigerant can improve the efficiency. As the heat source side refrigerant, for example, a single refrigerant such as R22, R134a, or R32, a near-azeotropic refrigerant mixture such as R410A or R404A, a refrigerant such as tetrafluoropropene such as HFO1234yf or HFO1234ze including a double bond in its chemical formula and considered to have a relatively low global warming potential, or a refrigerant that turns into a supercritical state such as CO2 or a natural refrigerant such as propane can be used. While the heat exchanger 15*a* related to heat medium or the heat exchanger 15*b* related to heat medium is operating for heating, a refrigerant that typically changes between two phases is condensed and liquefied and a refrigerant that turns into a supercritical state, such as CO2, is cooled in the supercritical state. As for the rest, either of the refrigerant acts in the same manner and offers the same advantages.

However, when a zeotropic refrigerant mixture such as R407C with a temperature difference between the saturated gas temperature and the saturated liquid temperature at the same pressure, or a refrigerant mixture of R32 and HFO1234yf is used as the heat source side refrigerant, the temperature gradient is efficiently exploit and thus the advantage becomes greater. Next, a case in which a zeotropic refrigerant mixture is used as the heat source side refrigerant will be described in detail.

Figure 8:
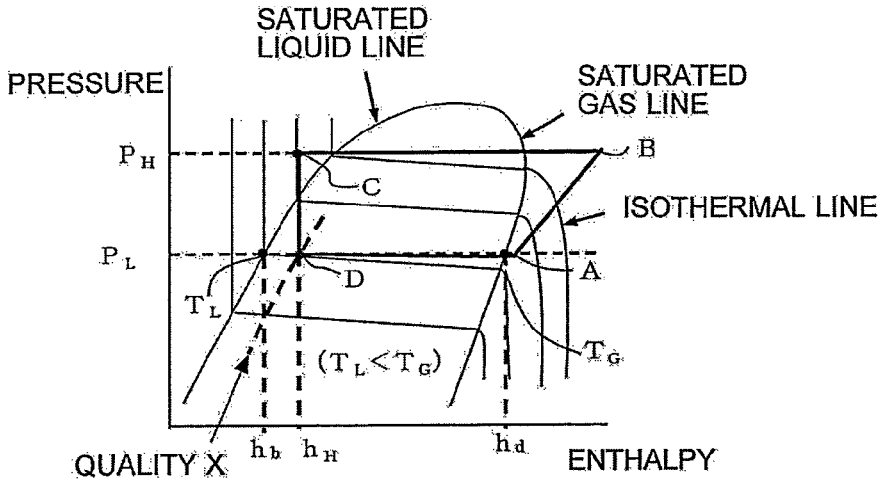
FIG. 8 is a p-h diagram illustrating the operational state in a case where a zeotropic refrigerant mixture is used as a heat source side refrigerant.

FIG. 8 is a p-h diagram illustrating the operational state in a case where a zeotropic refrigerant mixture is used as a heat source side refrigerant. A low temperature, low pressure gas refrigerant suctioned into the compressor 10 (Point A) is compressed into a high temperature, high pressure gas refrigerant (Point B). This high temperature, high pressure gas refrigerant is discharged from the compressor 10, and condensed in a heat exchanger operating as a condenser (the heat source side heat exchanger 12 or the heat exchanger 15*a* related to heat medium and/or the heat exchanger 15*b* related to heat medium) and turns into a high temperature, high pressure liquid refrigerant (Point C). This high temperature, high pressure liquid refrigerant is expanded in the expansion device 16*a* and/or the expansion device 16*b* and turns into a low temperature, low pressure two-phase refrigerant (Point D). The low temperature, low pressure two-phase refrigerant is evaporated in a heat exchanger operating as an evaporator (the heat source side heat exchanger 12 or the heat exchanger 15*a* related to heat medium and/or the heat exchanger 15*b* related to heat medium) and turns into a low temperature, low pressure gas refrigerant (Point A). Then, the refrigerant is suctioned into the compressor 10 again.

At this time, when a zeotropic refrigerant mixture is used, there is a temperature difference between the temperature of the saturated gas refrigerant and the temperature of the saturated liquid refrigerant at the same pressure. In the condenser, the temperature drops when the quality becomes smaller (the ratio of liquid refrigerant increases) in the two-phase region, and in the evaporator, the temperature rises when the quality becomes larger (the ratio of gas refrigerant increases) in the two-phase region.

Figure 9:
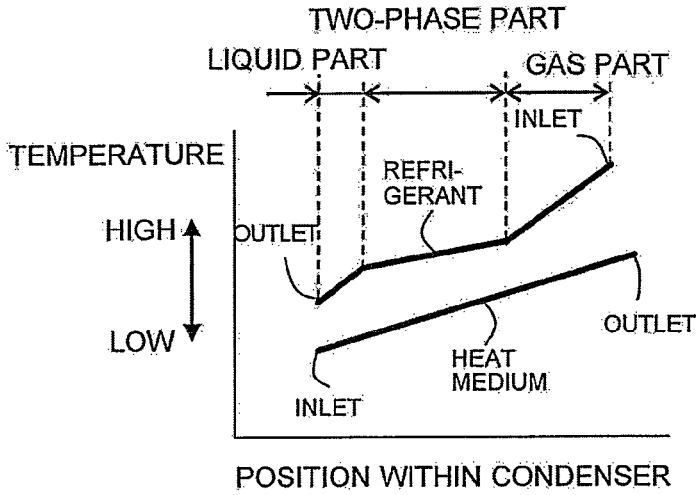
FIG. 9 is a diagram for describing the operation in a case where a heat exchanger related to heat medium is used as a condenser.
Figure 10:
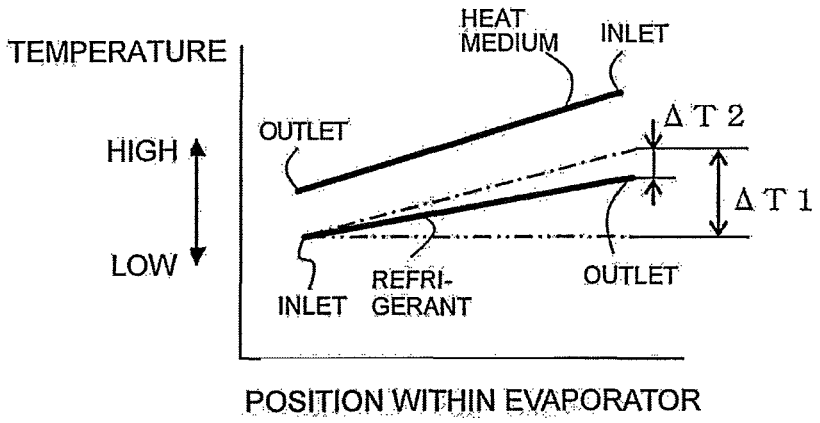
FIG. 10 is a diagram for describing the operation in a case where a heat exchanger related to heat medium is used as an evaporator.

The operation at this time will be described in detail with reference to FIGS. 9 and 10. FIG. 9 is a diagram for describing the operation in the case of using the heat exchanger 15*a* related to heat medium and/or the heat exchanger 15*b* related to heat medium as a condenser. FIG. 10 is a diagram for explaining the operation in the case of using the heat exchanger 15*a* related to heat medium and/or the heat exchanger 15*b* related to heat medium as an evaporator. Referring to FIG. 9, the horizontal axis and the vertical axis represent the positions of the heat source side refrigerant and heat medium inside the condenser, and the temperatures of the heat source side refrigerant and heat medium, respectively. Referring to FIG. 10, the horizontal axis and the vertical axis represent the positions of the heat source side refrigerant and heat medium inside the evaporator, and the temperatures of the heat source side refrigerant and heat medium, respectively.

With reference to FIG. 9, the operation in the case of using the heat exchanger 15*a* related to heat medium and/or the heat exchanger 15*b* related to heat medium as a condenser will be described. The heat source side refrigerant flows into the refrigerant side passage of the condenser in a gas state, drops in temperature by transferring heat to the heat medium on the outlet side of the heat medium passage of the condenser, and turns into a two-phase state. As the heat source side refrigerant in the two-phase state transfers heat to the heat medium, the ratio of liquid refrigerant increases, and its temperature drops in accordance with the temperature difference between the saturated gas refrigerant temperature and the saturated liquid refrigerant temperature. Thereafter, the heat source side refrigerant turns into a liquid state and the refrigerant further drops in temperature by transferring heat to the heat medium on the inlet side of the heat medium passage of the condenser. Meanwhile, the temperature of the heat medium rises from the inlet side toward the outlet side, because the heat source side refrigerant and the heat medium flow in counterflow (in opposing directions) in the heat exchanger 15 related to heat medium.

With reference to FIG. 10, the operation in the case of using the heat exchanger 15*a* related to heat medium and/or the heat exchanger 15*b* related to heat medium as an evaporator will be described. The heat source side refrigerant flows into the refrigerant side passage of the evaporator in a two-phase state, undergoes an increase in the ratio of gas refrigerant while removing heat from the heat medium on the outlet side of the heat medium passage of the evaporator, and rises in temperature in accordance with the temperature difference between the saturated gas refrigerant temperature and the saturated liquid refrigerant temperature. Finally, the heat source side refrigerant turns into a gas state by removing heat from the heat medium on the inlet side of the heat medium passage of the evaporator. Meanwhile, the temperature of the heat medium drops from the inlet side toward the outlet side, because the heat source side refrigerant and the heat medium flow in counterflow (in opposing directions) in the heat exchanger 15 related to heat medium.

At this time, if there is absolutely no pressure loss of the refrigerant within the refrigerant side passage of the evaporator, the temperature of the refrigerant rises by a temperature equivalent to the temperature difference between the saturated gas refrigerant temperature and the saturated liquid refrigerant temperature at the same pressure, along the line indicated by an alternate long and short dash line in FIG. 10. Referring to FIG. 10, the amount of this ideal temperature rise is represented by ΔT1. However, because there actually is pressure loss, the temperature rise of the refrigerant from the inlet to the outlet of the evaporator becomes smaller than the temperature rise indicated by the alternate long and short dash lines in FIG. 10, as indicated by a solid line. Referring to FIG. 10, the amount of this temperature drop due to the pressure loss of the refrigerant is represented by ΔT2.

When the amount of this temperature drop ΔT2 due to the pressure loss is smaller than the amount of temperature rise ΔT1 due to the temperature gradient of the refrigerant, that is, when the heat exchanger 15 related to heat medium is designed so that the amount of temperature drop falls within the range in which Expression (1) holds, at various positions within the heat exchanger, the temperature difference between the refrigerant and the heat medium can be made smaller than that in a case where a single refrigerant or a near-azeotropic refrigerant mixture with almost no temperature changes in the two-phase state is used, and the heat transfer efficiency improves. FIG. 10 assumes a case in which the refrigerant flows out of the evaporator in a saturated gas state, that is, a case in which the degree of superheat is zero. Irrespective of the degree of superheat, in a state in which Expression (1) holds, the refrigerant temperature in the intermediate portion of the heat exchanger 15 related to heat medium is higher than the refrigerant temperature at the inlet of the heat exchanger 15 related to heat medium.

$$\Delta T1 > \Delta T2 \qquad \text{Expression (1)}$$

Figure 11:
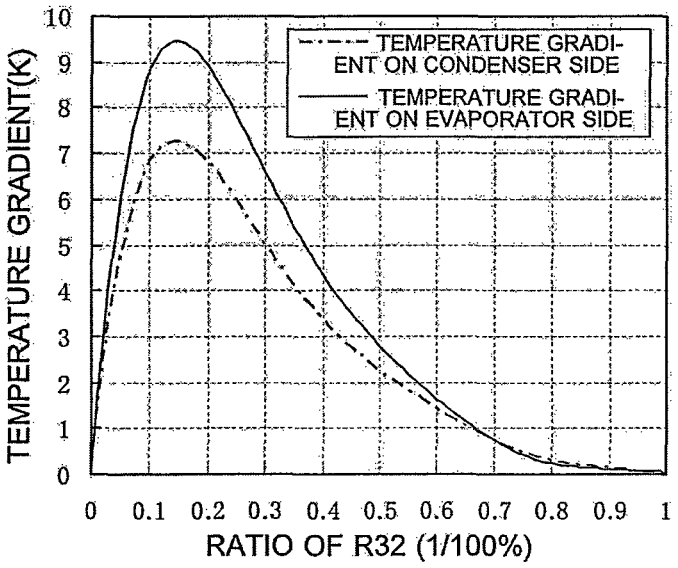
FIG. 11 is a diagram showing temperature gradients on the condenser side and on the evaporator side in a case where the mixing ratio of R32 is varied in a mixed refrigerant of R32 and HFO1234yf.

FIG. 11 is a diagram showing temperature gradients (vertical axis) on the condenser side and on the evaporator side in a case where the mixing ratio (mass %) of R32 is varied in a refrigerant mixture of R32 and HFO1234yf (horizontal axis). The solid line and the alternate long and short dash line shown in FIG. 11 indicate the temperature gradient on the evaporator side and the temperature gradient on the condenser side, respectively.

As shown in FIG. 11, the region in which the ratio of R32 ranges from 2 mass % to 50 mass % is the region in which the temperature gradient is largest, and the temperature gradient on the evaporation side ranges from approximately 2.8 to 9.5 (K). When the ratio of the refrigerant falls within this region, because the temperature gradient is large, Expression (1) holds even in the presence of a somewhat large temperature drop due to pressure loss, and the heat exchanger can be effectively used.

Figure 12:
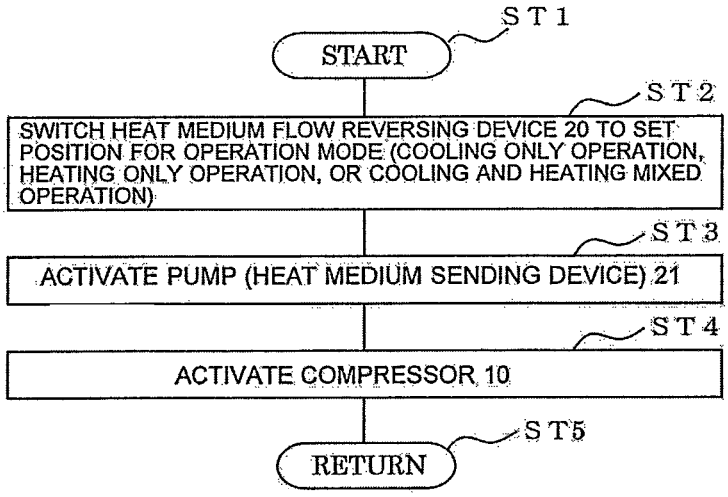
FIG. 12 is a flowchart showing the flow of control process of a heat medium flow reversing device.

Next, control of the heat medium flow reversing device 20 will be described. FIG. 12 is a flowchart showing the flow of control process of the heat medium flow reversing device 20. The activation procedure in a case in which the compressor 10 is in a stopped state is as shown in the flowchart of FIG. 12. Specifically, activation of the compressor 10 is started when an activation command is issued (ST1). The unshown controller switches the heat medium flow reversing device 20 to the set position for the operation mode currently set (cooling only operation mode, heating only operation mode, or cooling and heating mixed operation mode (cooling main operation mode or heating main operation mode)) (ST2). Then, the pump 21 is activated (ST3). Thereafter, the compressor 10 is activated (ST4). The activation process of the compressor 10 is performed through the above-mentioned procedure, and the activation process is ended (ST5).

By directing the heat medium flow reversing device 20 to a direction corresponding to the operation mode currently set in advance before activating the pump 21, the passage for the pump 21 is reliably secured, and stable operation can be achieved.

When operation has stopped, the pump 21 and the compressor 10 are stopped without changing the heat medium flow reversing device 20 from the position during operation. Then, when operation is resumed, the pump 21 and the compressor 10 may be activated in accordance with the flowchart shown in FIG. 12. When operation is resumed, operation is performed again in the same state as the previous operational state in many cases. Accordingly, by ensuring that the position of the heat medium flow reversing device 20 when operation stops does not change from the position during operation, the activation time can be further made quicker and stable operation can be achieved more quickly.

When switching from the cooling only operation mode to the cooling main operation mode, when switching from the heating only operation mode to the heating main operation mode, when switching from the cooling main operation mode to the cooling only operation mode, or when switching from the heating main operation mode to the heating only operation mode, the direction of the heat medium flow reversing device 20 corresponding to one of the pumps 21 switches, and the flow direction of the heat medium within the heat exchanger 15 related to heat medium reverses. Consequently, a state in which the flow rate becomes zero occurs instantaneously during the switching, and accordingly, it is preferable to switch the heat medium flow reversing device 20 after reducing the flow rate of the heat medium passing through corresponding pump 21 in advance. In this way, an abrupt change in flow rate can be prevented, and the operation mode can be switched in a stable manner.

As a method for reducing the flow rate through the pump 21, in a case in which the pump 21 is driven by a brushless DC inverter or an AC inverter or the like, the flow rate may be reduced by reducing the frequency. In a case where the pump 21 is not of an inverter type, the voltage applied to the pump 21 may be reduced by a method such as switching the resistance, or a valve that can vary the opening area of the passage may be provided on the suction side or discharge side of the pump so that the flow rate to the pump 21 may be reduced by reducing the passage area.

[Refrigerant Pipes 4]

As described above, the air-conditioning apparatus 100 according to Embodiment has several operation modes. In these operation modes, the heat source side refrigerant flows through the refrigerant pipes 4 connecting the outdoor unit 1 and the heat medium relay unit 3.

[Pipes 5]

In some operation modes carried out by the air-conditioning apparatus 100 according to Embodiment, the heat medium, such as water or antifreeze, flows through the pipes 5 connecting the heat medium relay unit 3 and the indoor units 2.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are controlled so as to have a medium opening degree, such that the heat medium flows into both of the heat exchanger 15*a* related to heat medium and the heat exchanger 15*b* related to heat medium. Consequently, since both of the heat exchanger 15*a* related to heat medium and the heat exchanger 15*b* related to heat medium can be used for the heating operation or the cooling operation, the heat transfer area is increased, so that the heating operation or the cooling operation can efficiently be performed.

In addition, in the case where the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger 15*b* related to heat medium for heating, and the first heat medium flow switching device 22 and the second heat medium flow switching device 23 corresponding to the use side heat exchanger 26 which performs the cooling operation are switched to the passage connected to the heat exchanger 15*a* related to heat medium for cooling, so that the heating operation or cooling operation can be freely performed in each indoor unit 2.

Furthermore, each of the first heat medium flow switching devices 22 and the second heat medium flow switching devices 23 described in Embodiment may be any component which can switch passages, for example, a three-way valve capable of switching between flow directions in a three-way passage, or two two-way valves, such as on-off valves opening or closing a two-way passage used in combination. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case where each of the heat medium flow control devices 25 is a two-way valve, each of the heat medium flow control devices 25 may be a control valve having a three-way passage and the valve may be disposed with a bypass pipe that bypasses the corresponding use side heat exchanger 26.

Furthermore, each of the heat medium flow control devices 25 may be a two-way valve or a three-way valve whose one end is closed as long as it is capable of controlling a flow rate in a passage in a stepping-motor-driven manner. Alternatively, as regards each of the heat medium flow control device 25, a component, such as an on-off valve, which is capable of opening or closing a two-way passage, may be used while ON and OFF operations are repeated to control an average flow rate.

While it has been described as if the first heat medium flow switching device 22 and the heat medium flow control device 25 were separated, in a case where two devices driven by a stepping motor and capable of controlling the flow rate through a two-way passage are combined as the first heat medium flow switching device 22, the first heat medium flow switching device 22 can also function as the heat medium flow control device 25, and thus there is no need to install the heat medium flow control device 25 separately. That is, as long as flow switching and flow control can be performed simultaneously, the first heat medium flow switching device 22 and the heat medium flow control device 25 may be the same.

As the heat medium flow reversing device 20, other than a device such as a three-way valve that can switch a three-way passages, two devices such as on-off valves illustrated in FIG. 7 that open and close a two-way passage may be combined, and any devices that can switch the passage may be used. Alternatively, components such as a stepping-motor-driven mixing valve capable of changing flow rates of three-way passages or electronic expansion valves capable of changing flow rates of two-way passages used in combination may be used.

Furthermore, while each second refrigerant flow switching device 18 is described as a four-way valve, the device is not limited to this type. A plurality of two-way or three-way flow switching valves may be used such that the refrigerant flows in the same way.

While the air-conditioning apparatus 100 according to Embodiment has been described with respect to the case in which the apparatus can perform the cooling and heating mixed operation, the apparatus is not limited to the case. Even in an apparatus that is configured by a single heat exchanger 15 related to heat medium and a single expansion device 16 that are connected to a plurality of parallel use side heat exchangers 26 and heat medium flow control devices 25, and even in an apparatus that is only capable of carrying out a cooling operation or a heating operation, the same advantages can be obtained.

In addition, it is needless to say that the same holds true for the case where one use side heat exchanger 26 and one heat medium flow control device 25 are connected. Moreover, obviously, there is no problem if a plurality of components acting in the same way are arranged as the heat exchangers 15 related to heat medium and the expansion devices 16. Furthermore, while the case where the heat medium flow control devices 25 are arranged in the heat medium relay unit 3 has been described, the arrangement is not limited to this case. Each heat medium flow control device 25 may be disposed in the indoor unit 2. The heat medium relay unit 3 may be separated from the indoor unit 2.

While the case where a plate heat exchanger is used as each of the heat exchanger 15*a* related to heat medium and the heat exchanger 15*b* related to heat medium has been described, a heat exchanger related to heat medium configured as a double-pipe heat exchanger, a micro-channel heat exchanger, or the like may be used.

In addition, while Embodiment has been described with respect to the case where two heat exchangers function as the heat exchanger 15*a* related to heat medium and heat exchanger 15*b* related to heat medium, the arrangement is not limited to this case. As long as each heat exchanger 15 related to heat medium is configured to be capable of cooling and/or heating the heat medium, the number of heat exchangers 15 related to heat medium arranged is not limited.

As the heat medium, for example, brine (antifreeze), water, a mixed solution of brine and water, or a mixed solution of water and an additive with high anticorrosive effect can be used. In the air-conditioning apparatus 100, therefore, even if the heat medium leaks through the indoor unit 2 into the indoor space 7, the safety of the heat medium used is high. Accordingly, it contributes to safety improvement.

While Embodiment has been described with respect to the case in which the air-conditioning apparatus 100 includes the accumulator 19, the accumulator 19 may be omitted. Typically, each of the heat source side heat exchanger 12 and the use side heat exchangers 26 is provided with an air-sending device and in many cases, air sending facilitates condensation or evaporation. However, the structure is not limited to this case. For example, a panel heater and the like, taking advantage of radiation can be used as the use side heat exchanger 26 and a water-cooled heat exchanger which transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26.

While the case where the heat medium flow reversing devices 20*a* to 20*d* are connected to the heat medium passages of the heat exchangers 15*a* and 15*b* related to heat medium and has been described above, the heating efficiency in the heat source side heat exchanger 12 can be improved also in the configuration in which the heat source side heat exchanger 12 is a water-cooled heat exchanger, and the passage on the refrigerant side reverses in the heat source side heat exchanger 12. In this case, the heat medium flow reversing device 20*a* and the heat medium flow reversing device 20*b* may be connected to the heat source side heat exchanger 12 in the same manner as the heat exchanger 15 related to heat medium.

In the case where the heat source side heat exchanger 12 is a water-cooled heat exchanger, the air-conditioning apparatus may be of a direct expansion type which circulates refrigerant between the heat source side heat exchanger 12 and the use side heat exchangers 26*a* to 26*d*, and the same advantages can be obtained. Furthermore, while an exemplary description in which there are four use side heat exchangers 26*a* to 26*d* has been given, any number thereof can be connected. Furthermore, each of the number of pumps 21*a* and 21*b* is not limited to one. A plurality of pumps having a small capacity may be arranged in parallel.

While the case where the heat medium flow reversing devices 20*a* to 20*d* are installed in the heat medium relay unit 3 that is a separate component from the outdoor unit 1 has been described, the arrangement is not limited to this case. Although energy saving performance deteriorates slightly owing to an increase in conveyance power of water, the heat exchanger 15*a* related to heat medium, the heat exchanger 15*b* related to heat medium, and the heat medium flow reversing devices 20*a* to 20*d* may be installed in the outdoor unit 1.

As described above, the air-conditioning apparatus 100 according to Embodiment improves safety by not allowing the heat source side refrigerant to circulate to each indoor unit 2 or the vicinity of the indoor unit 2, and by not allowing an the heat medium that has leaked from the connections between the pipes 5 and individual actuators (driving parts such as the pump 21, the first heat medium flow switching device 22, the second heat medium flow switching device 23, the expansion device 16, and the second refrigerant flow switching device 18) to flow out to the air-conditioned space. Moreover, because the heat transfer efficiency of the heat exchanger 15 related to heat medium can be improved, the air-conditioning apparatus 100 can contribute to improvement of energy efficiency. Additionally, the air-conditioning apparatus 100 can save energy because the pipes 5 can be made shorter. Moreover, the air-conditioning apparatus 100 includes a reduced number of pipes (the refrigerant pipes 4, the pipes 5) connecting the outdoor unit 1 and the heat medium relay unit 3 or connecting the heat medium relay unit 3 and the indoor unit 2 to make the installation easier.

REFERENCE SIGNS LIST

1 outdoor unit; 2 indoor unit; 2*a* indoor unit; 2*b* indoor unit; 2*c* indoor unit; 2*d* indoor unit; 3 heat medium relay unit; 4 refrigerant pipe; 4*a* first connecting pipe; 4*b* second connecting pipe; 5 pipe; 6 outdoor space; 7 indoor space; 8 space; 9 structure; 10 compressor; 11 first refrigerant flow switching device; 12 heat source side heat exchanger; 13*a* check valve; 13*b* check valve; 13*c* check valve; 13*d* check valve; 15 heat exchanger related to heat medium; 15*a* heat exchanger related to heat medium; 15*b* heat exchanger related to heat medium; 16 expansion device; 16*a* expansion device; 16*b* expansion device; 17 opening and closing device; 17*a* opening and closing device; 17*b* opening and closing device; 18 second refrigerant flow switching device; 18*a* second refrigerant flow switching device; 18*b* second refrigerant flow switching device; 19 accumulator; 20 heat medium flow reversing device; 20*a* heat medium flow reversing device; 20*a*(1) on-off valve; 20*a*(2) on-off valve; 20*b* heat medium flow reversing device; 20*b*(1) on-off valve; 20*b*(2) on-off valve; 20*c* heat medium flow reversing device; 20*c*(1) on-off valve; 20*c*(2) on-off valve; 20*d* heat medium flow reversing device; 20*d*(1) on-off valve: 20*d*(2) on-off valve; 21 pump; 21*a* pump; 21*b* pump; 22 first heat medium flow switching device; 22*a* first heat medium flow switching device; 22*b* first heat medium flow switching device; 22*c* first heat medium flow switching device; 22*d* first heat medium flow switching device; 23 second heat medium flow switching device; 23*a* second heat medium flow switching device; 23*b* second heat medium flow switching device; 23*c* second heat medium flow switching device; 23*d* second heat medium flow switching device; 25 heat medium flow control device; 25*a* heat medium flow control device; 25*b* heat medium flow control device; 25*c* heat medium flow control device; 25*d* heat medium flow control device; 26 use side heat exchanger; 26*a* use side heat exchanger; 26*b* use side heat exchanger; 26*c* use side heat exchanger; 26*d* use side heat exchanger; 31 first temperature sensor; 31*a* first temperature sensor; 31*b* first temperature sensor; 34 second temperature sensor; 34*a* second temperature sensor; 34*b* second temperature sensor; 34*c* second temperature sensor; 34*d* second temperature sensor; 35 third temperature sensor; 35*a* third temperature sensor; 35*b* third temperature sensor; 35*c* third temperature sensor; 35*d* third temperature sensor; 36 pressure sensor; 41 motor; 42 rotary tube; 43 hole; 44(*a*) joint; 44(*b*) joint; 100 air-conditioning apparatus: A refrigerant circuit; B heat medium circuit; a connection port connected to end of rotary tube of heat medium flow reversing device; b connection port connected to side part of rotary tube of heat medium flow reversing device; c connection port connected to side part of rotary tube of heat medium flow reversing device.

The invention claimed is:

1. An air-conditioning apparatus comprising:

a refrigerant circuit in which a compressor, a first heat exchanger, a first expansion device, and a refrigerant side passage of a second heat exchanger are connected by refrigerant pipes to circulate a heat source side refrigerant; and a heat medium circuit in which a pump and a heat medium side passage of the second heat exchanger are connected by heat medium pipes to circulate a heat medium, wherein the second heat exchanger exchanges heat between the heat source side refrigerant and the heat medium, the apparatus comprising:

a heat medium flow reversing device provided in the heat medium circuit for switching a flow direction of the heat medium in the heat medium side passage of the second heat exchanger, and wherein the heat medium flow reversing device is formed by a plurality of three-way valves that are each provided with a motor, a rotary tube having a cylindrical shape, and a hole that is provided in a side face of the rotary tube and that allows the heat medium to flow between an inside and an outside of the rotary tube, the plurality of three-way valves being able to vary a position of the hole in the side face of the rotary tube in a circumferential direction by rotating the rotary tube by an action of the motor, the plurality of three-way valves being divided into two sets; and the heat medium that circulates through the heat medium circuit flows from an end of a rotary tube in one set of the heat medium flow reversing devices, and flows out of an end of a rotary tube in another set of the heat medium flow reversing devices, in both of a case in which the heat medium is cooled in the heat exchanger related to heat medium and a case where the heat medium is heated in the heat exchanger related to heat medium.

2. The air-conditioning apparatus of claim 1, wherein the heat medium flow reversing device reverses the flow direction of the heat medium in the second heat exchanger, and can switch a relationship of a flow direction of the heat source side refrigerant and the flow direction of the heat medium between a parallel flow and a counter flow in the second heat exchanger.

3. The air-conditioning apparatus of claim 2, wherein the flow direction of the heat medium in the second heat exchanger is switched in accordance with the flow direction of the heat source side refrigerant.

4. The air-conditioning apparatus of claim 3, wherein the second heat exchanger is a plate heat exchanger, wherein a passage is formed in which when the second heat exchanger heats the heat medium, the heat source side refrigerant flows from an upper side toward a lower side, and the heat medium flows from the lower side toward the upper side, and when the second heat exchanger cools the heat medium, the heat source side refrigerant flows from the lower side toward the upper side, and the heat medium flows from the upper side toward the lower side.

5. The air-conditioning apparatus of claim1, wherein the heat medium flow reversing device is configured by a three-way valve disposed at each of one end and another end of the heat medium side passage of the second heat exchanger.

6. The air-conditioning apparatus of claim 5, wherein:

the heat medium flow reversing device is configured by a first heat medium flow reversing device that is connected by pipes to one end of the second heat exchanger, and another end of the second heat exchanger via a first connection port, and a second heat medium flow reversing device that is connected by pipes to the other end of the second heat exchanger, and the one end of the second heat exchanger via a second connection port;

the first connection port is disposed in a passage between the other end of the second heat exchanger and the second heat medium flow reversing device; and the second connection port is disposed in a passage between the one end of the second heat exchanger and the first heat medium flow reversing device.

7. The air-conditioning apparatus of claim 1, comprising:

a plurality of the second heat exchangers and a plurality of the pumps, wherein:

the heat medium circuit includes a third heat exchanger that supplies cooling energy or heating energy to an air-conditioned space, and a heat medium flow switching device that selects either the heat medium that has been cooled or the heat medium that has been heated, and can pass the selected heat medium to the third heat exchanger; and the heat medium sent from each of the pumps of the plurality of the pumps is circulated to the third heat exchanger via the heat medium flow switching device.

8. The air-conditioning apparatus of claim 7, comprising:

a cooling and heating mixed operation function that heats a part of the heat medium, and cools the remaining heat medium;

a heating only operation function that only heats the heat medium; and a cooling only operation function that only cools the heat medium, wherein in the cooling and heating mixed operation function, a flow direction of the heat medium in the second heat exchanger for heating and a flow direction of the heat medium in the second heat exchanger for cooling are opposite to each other, and in the heating only operation function and the cooling only operation function, the flow directions of the heat medium in a plurality of the second heat exchangers are the same.

9. The air-conditioning apparatus of claim 8, wherein in any one of the cooling only operation function, the heating only operation function, and the cooling and heating mixed operation function, in every third heat exchanger, a flow direction of the heat medium and a flow direction of a second heat medium that flows around the third heat exchanger are in counterflow.

10. The air-conditioning apparatus of claim 1, wherein:

the compressor and the first heat exchanger are accommodated in an outdoor unit;

the second heat exchanger, the pump, and the heat medium flow reversing device are accommodated in a heat medium relay unit;

a third heat exchanger is accommodated in an indoor unit; and the outdoor unit, the heat medium relay unit, and the indoor unit are each formed as a separated body.

11. The air-conditioning apparatus of claim 10, wherein the outdoor unit is connected to the heat medium relay unit by two pipes and the heat medium relay unit is connected to the indoor unit by two pipes.

12. The air-conditioning apparatus of claim 10, wherein:

the heat medium circuit is provided with a heat medium flow control device that controls a flow rate of the heat medium circulated to the third heat exchanger; and the heat medium flow control device is accommodated in the heat medium relay unit.

13. The air-conditioning apparatus of claim 1, wherein as the heat source side refrigerant, a zeotropic refrigerant mixture that includes two or more components, and has a temperature difference between a saturated gas refrigerant temperature and a saturated liquid refrigerant temperature at a same pressure is used.

14. The air-conditioning apparatus of claim 13, wherein in the heat source side refrigerant, in a case where the second heat exchanger is used as an evaporator, a temperature drop due to pressure loss of the heat source side refrigerant in the second heat exchanger is smaller than the temperature difference between the saturated gas refrigerant temperature and the saturated liquid refrigerant temperature, and a refrigerant temperature in an intermediate portion of the second heat exchanger is higher than a refrigerant temperature at an inlet of the second heat exchanger.

15. The air-conditioning apparatus of claim 13, wherein the heat source side refrigerant is the zeotropic refrigerant mixture including at least R32 and tetrafluoropropene.

16. The air-conditioning apparatus of claim 15, wherein a ratio of R32 in the heat source side refrigerant is not less than 2 mass % and not more than 50 mass %.

17. The air-conditioning apparatus of claim 1, further comprising a controller that controls the heat medium flow reversing device, the controller is configured to:

when the pump is activated from a stopped state responsive to receipt of an activation command, switch the heat medium flow reversing device to a set position which corresponds to an operation mode currently set, and then activate the pump.

18. The air-conditioning apparatus of claim 1, further comprising a controller that controls the heat medium flow reversing device, the controller is configured to:

when the compressor is stopped from a state in operating, control the heat medium flow reversing device to not change from a position of the heat medium flow reversing device during operation.

19. The air-conditioning apparatus of claim 1, further comprising a controller that controls the heat medium flow reversing device, the controller is configured to:

when reversing a direction of the heat medium upon switching of an operation mode, switch the heat medium flow reversing device after a flow rate of the heat medium passing through the pump is reduced.

20. The air-conditioning apparatus of claim 1, wherein:

in the one set of the heat medium flow reversing devices on an inlet side, the heat medium flows from an inside of the rotary tube to a side face of the rotary tube; and in the other set of the heat medium flow reversing devices on an outlet side, the heat medium flows from a side face of the rotary tube to an inside of the rotary tube.

21. The air-conditioning apparatus of claim 1, comprising a single joint having a three-way passage, and provided at each of a position in a passage between the one set of the heat medium flow reversing devices and the second heat exchanger, and a position in a passage between the other set of the heat medium flow reversing devices and the second heat exchanger.

* * * * *